US008151598B2

(12) United States Patent
Wittern, Jr. et al.

(10) Patent No.: US 8,151,598 B2
(45) Date of Patent: Apr. 10, 2012

(54) APPARATUS AND METHOD FOR SINGLE OR MULTIPLE TEMPERATURE ZONE(S) IN REFRIGERATED VENDING MACHINE

(75) Inventors: Francis A. Wittern, Jr., West Des Moines, IA (US); Gerald J. Parle, Ames, IA (US)

(73) Assignee: Fawn Engineering Corporation, Des Moines, IA (US)

( * ) Notice: Subject to any disclaimer, the term of this patent is extended or adjusted under 35 U.S.C. 154(b) by 838 days.

(21) Appl. No.: 12/248,818

(22) Filed: Oct. 9, 2008

(65) Prior Publication Data

US 2009/0090734 A1 Apr. 9, 2009

Related U.S. Application Data

(60) Provisional application No. 60/998,186, filed on Oct. 9, 2007.

(51) Int. Cl.
*F25D 17/04* (2006.01)

(52) U.S. Cl. ..... 62/408; 62/440

(58) Field of Classification Search ..... 62/406, 62/408, 407, 440, 441, 337, 314, 126; 454/236, 454/319

See application file for complete search history.

(56) References Cited

U.S. PATENT DOCUMENTS

| | | | | | |
|---|---|---|---|---|---|
| 4,043,624 | A * | 8/1977 | Lindenschmidt | 312/406 |
| 4,509,335 | A * | 4/1985 | Griffin et al. | 62/77 |
| 4,688,393 | A * | 8/1987 | Linstromberg et al. | 62/187 |
| 4,823,984 | A * | 4/1989 | Ficken | 221/96 |
| 4,920,765 | A * | 5/1990 | McCauley et al. | 62/408 |
| 5,477,699 | A * | 12/1995 | Guess et al. | 62/187 |
| 5,546,759 | A * | 8/1996 | Lee | 62/441 |
| 5,758,512 | A * | 6/1998 | Peterson et al. | 62/407 |
| 5,899,083 | A * | 5/1999 | Peterson et al. | 62/186 |
| 6,637,235 | B2 * | 10/2003 | Sakamoto et al. | 62/443 |
| 7,150,155 | B2 * | 12/2006 | Faber | 62/63 |
| 7,152,419 | B1 * | 12/2006 | Armour et al. | 62/187 |
| 2002/0005686 | A1 * | 1/2002 | Nuttall et al. | 312/236 |
| 2003/0024254 | A1 * | 2/2003 | Yoshida et al. | 62/78 |
| 2004/0050079 | A1 * | 3/2004 | Holmes et al. | 62/187 |
| 2005/0211721 | A1 * | 9/2005 | Chirnomas et al. | 221/123 |
| 2005/0252925 | A1 * | 11/2005 | Kelly | 221/92 |
| 2006/0000846 | A1 * | 1/2006 | Schwarzli | 221/196 |
| 2006/0090496 | A1 * | 5/2006 | Adamski et al. | 62/344 |
| 2006/0150658 | A1 * | 7/2006 | Schuchart | 62/340 |
| 2007/0157655 | A1 * | 7/2007 | Eveland et al. | 62/377 |

* cited by examiner

*Primary Examiner* — Mohammad Ali
(74) *Attorney, Agent, or Firm* — McKee, Voorhees & Sease, P.L.C.

(57) ABSTRACT

An automated vending machine that can be selectively configured to include one or several temperature zones. A single refrigeration system and universal interior allows easy and economical assembly into a one, two, or three temperature zone machine. Thermal breaks and dividers are used to partition zones, when needed. The basic vending machine cabinet, dispensers, and controls are not changed between configurations. In one aspect, a universal air duct can be used for all three configurations, with minor changes.

19 Claims, 41 Drawing Sheets

LINER - TOP, BOTTOM, OPPISITE
SIDES, AND BACK

AIR CHUTE - MOUNTABLE TO BACK
VERTICAL WALL OF LINER

DISPENSING TRAYS

SINGLE DISPENSING TRAY

TRAY - BOTTOM VIEW

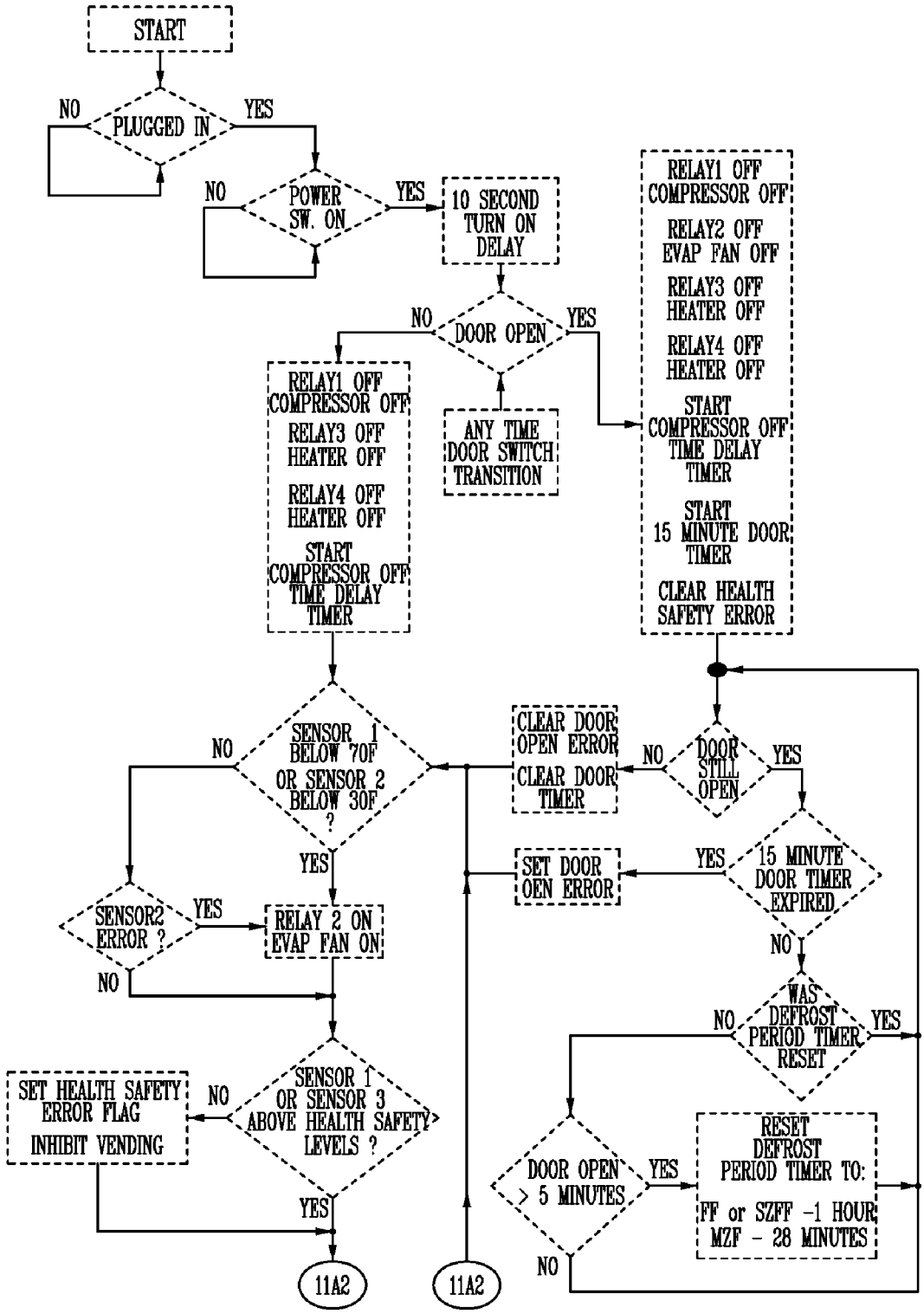
*Fig. 11A1*

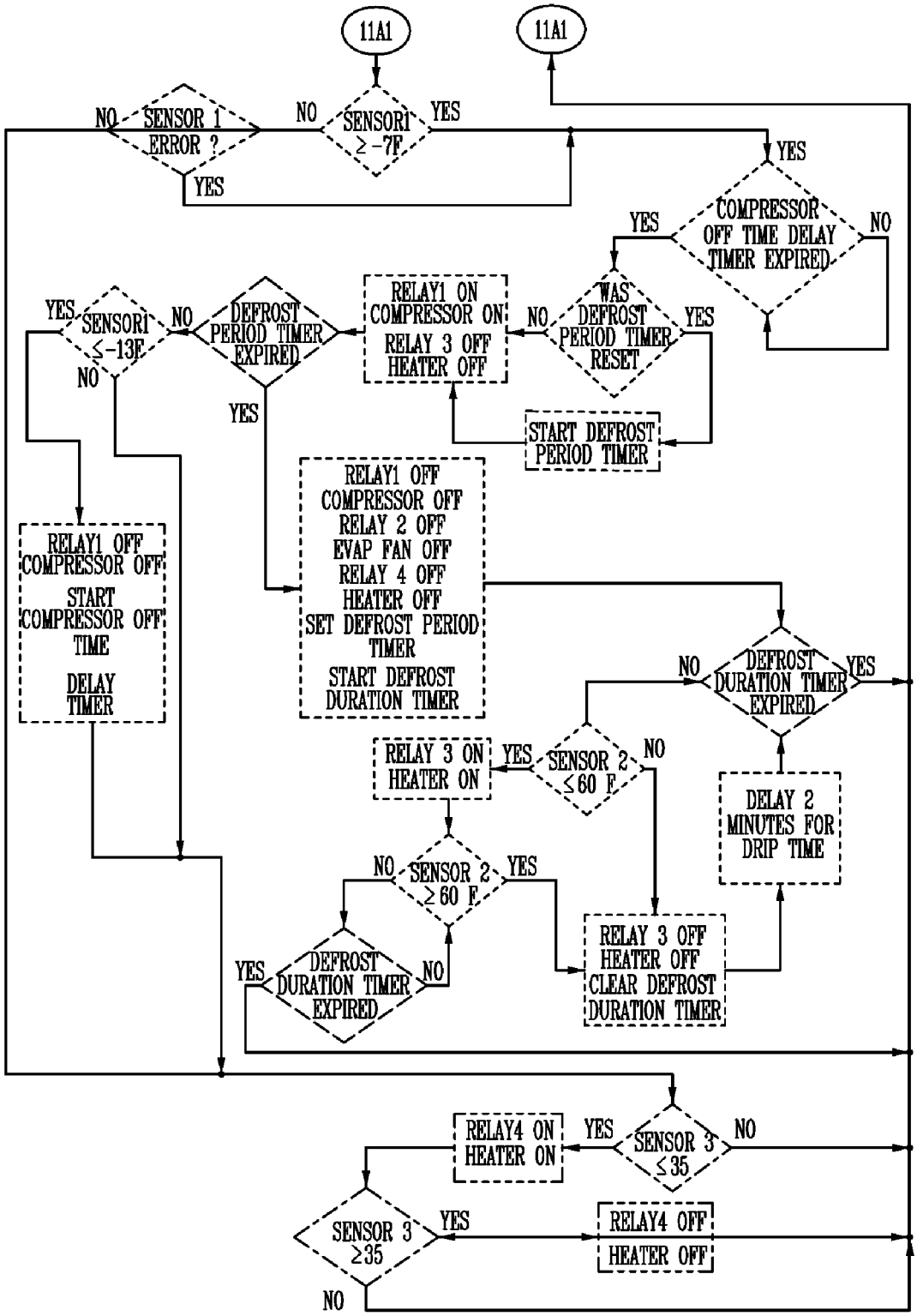
*Fig. 11A2*

MZF2010 HEAT LOADS

DESIGN DATA

| | |
|---|---|
| AMBIENT DRY BULB (F) | 100 |
| AMBIENT WET BULB (F) | 81 |
| PRODUCT TEMPERATURE (F) | -10 |
| DELTA TEMPERATURE (F) | 110 |

| | |
|---|---|
| CABINET FOAM THICKNESS (INCHES) | |
| GLASS R-VALUE (SQ-FT-F-H/BTU) | 1.82 |
| PRODUCT PULL-DOWN TIME (HRS) | 1 |
| TOTAL DESIGN LOAD (BTU/HR) | 1717 |

AREAS

| | WIDTH (INCHES) | HEIGHT (INCHES) | AREA (SQ-FT) |
|---|---|---|---|
| TOP | 17.9 | 27.2 | 3.38 |
| SIDE1 | 27.2 | 52.8 | 9.97 |
| SIDE2 | 27.2 | 52.8 | 9.97 |
| BOTTOM | 17.9 | 27.2 | 3.38 |
| BACK | 17.9 | 52.8 | 6.56 |
| FRONT | 17.9 | 52.8 | 1.87 |
| TOTAL CABINET AREA (SQ-FT) | | | 1.87 |

| | WIDTH (INCHES) | HEIGHT (INCHES) | AREA (SQ-FT) |
|---|---|---|---|
| GLASS | 45 | 15 | 4.69 |

INTERNAL HEAT GAINS

| | WATTS | BTUH |
|---|---|---|
| FAN(S) | 53 | 517 |
| HEATERS | 120 | 409 |
| LIGHTS | 55 | 188 |
| TOTAL INTERNAL HEAT GAIN | | 1114 |

CABINET HEAT GIANS

| K-FACTOR | INCHES OF FOAM | DELTA (F) | BTU/SQ-FT/24HR | Q (BTU/HR) |
|---|---|---|---|---|
| 0.15 | 2 | 110 | 198 | 28 |
| 0.15 | 2 | 110 | 198 | 82 |
| 0.15 | 2 | 110 | 198 | 82 |
| 0.15 | 2 | 120 | 216 | 30 |
| 0.15 | 2 | 110 | 198 | 54 |
| 0.15 | 1 | 110 | 396 | 31 |
| | | TOTAL CABINET LOAD (BTU/HR) | | 308 |

| R-VALUE | GLAZINGS | DELTA (F) | BTU/SQ-FT/24HR | Q (BTU/HR) |
|---|---|---|---|---|
| 1.75 | 3 | 110 | 62.86 | 295 |
| | | GLASS THERMAL LOAD (BTU/HR) | | 295 |

PRODUCT LOAD

| P.D. TIME | CAPACITY | SIZE (OZ) | CP (BTU/BL/F) | Q (BTU'S) |
|---|---|---|---|---|
| 1 | 0 | 20 | 1 | 0 |
| | | PRODUCT PULL-DOWN LOAD (BTU/HR) | | 0 |

*Fig. 11B*

| | EVAPORATING TEMPERATURE | F | -40 | -35 | -30 | -25 | -20 | -15 | -10 | -5 | 0 | 5 | 10 | 15 | 20 | 25 | 30 | 35 | 40 | 45 |
|---|---|---|---|---|---|---|---|---|---|---|---|---|---|---|---|---|---|---|---|---|
| | | C | -40.0 | -37.2 | -34.4 | -31.7 | -28.9 | -26.1 | -23.3 | -20.6 | -17.8 | -15.0 | -12.2 | -9.4 | -6.7 | -3.9 | -1.1 | -1.7 | 4.4 | 7.2 |
| AMBIENT 110° F 43.3° C | CAPACITY (BLU/H) | | 647 | 839 | 1,031 | 1,246 | 1,462 | 1,703 | 1,944 | 2,212 | 2,481 | 2,777 | | | | | | | | |
| | CAPACITY (W) | | 190 | 246 | 302 | 365 | 429 | 499 | 570 | 649 | 727 | 814 | | | | | | | | |
| | POWER CONSUMPTION | | 329.4 | 376 | 422.4 | 467 | 511.1 | 555 | 599.2 | 644 | 689.3 | 737 | | | | | | | | |
| | CURRENT (A) | | 6.1 | 6.2 | 6.4 | 6.7 | 6.9 | 7.2 | 7.5 | 7.8 | 8.1 | 8.5 | | | | | | | | |
| | EER (BLU/WH) | | 1.96 | 2.20 | 2.44 | 2.65 | 2.85 | 3.05 | 3.25 | 3.42 | 3.60 | 3.76 | | | | | | | | |
| AMBIENT 100° F 37.8° C | CAPACITY (BLU/H) | | 795 | 988 | 1,181 | 1,400 | 1,619 | 1,864 | 2,110 | 2,383 | 2,656 | 2,956 | 3,256 | | | | | | | |
| | CAPACITY (W) | | 233 | 290 | 346 | 411 | 475 | 547 | 619 | 699 | 779 | 867 | 955 | | | | | | | |
| | POWER CONSUMPTION | | 397 | 438 | 479 | 519 | 560 | 600 | 641 | 684 | 727 | 774 | 820 | | | | | | | |
| | CURRENT (A) | | 6.1 | 6.3 | 6.5 | 6.7 | 6.9 | 7.2 | 7.4 | 7.7 | 8.0 | 8.4 | 8.7 | | | | | | | |
| | EER (BLU/WH) | | 2.01 | 2.24 | 2.47 | 2.68 | 2.89 | 3.09 | 3.29 | 3.47 | 3.65 | 3.81 | 3.97 | | | | | | | |
| AMBIENT 90° F 32.2° C | CAPACITY (BLU/H) | | 976 | 1,176 | 1,376 | 1,606 | 1,837 | 2,099 | 2,360 | 2,654 | 2,947 | 3,270 | 3,593 | | | | | | | |
| | CAPACITY (W) | | 286 | 345 | 404 | 471 | 539 | 615 | 692 | 778 | 864 | 959 | 1,054 | | | | | | | |
| | POWER CONSUMPTION | | 413 | 449 | 485 | 521 | 557 | 594 | 632 | 673 | 713 | 758 | 803 | | | | | | | |
| | CURRENT (A) | | 6.3 | 6.4 | 6.5 | 6.7 | 6.9 | 7.1 | 7.4 | 7.7 | 7.9 | 8.3 | 8.6 | | | | | | | |
| | EER (BLU/WH) | | 2.36 | 2.60 | 2.84 | 3.07 | 3.30 | 3.52 | 3.73 | 3.93 | 4.13 | 4.30 | 4.47 | | | | | | | |
| AMBIENT 80° F 26.7° C | CAPACITY (BLU/H) | | 1,156 | 1,363 | 1,571 | 1,813 | 2,055 | 2,333 | 2,610 | 2,924 | 3,237 | 3,584 | 3,930 | | | | | | | |
| | CAPACITY (W) | | 338 | 400 | 461 | 532 | 603 | 684 | 765 | 857 | 949 | 1,051 | 1,153 | | | | | | | |
| | POWER CONSUMPTION | | 429 | 460 | 491 | 522 | 554 | 588 | 623 | 661 | 699 | 743 | 787 | | | | | | | |
| | CURRENT (A) | | 6.4 | 6.5 | 6.6 | 6.8 | 6.9 | 7.1 | 7.3 | 7.6 | 7.8 | 8.1 | 8.4 | | | | | | | |
| | EER (BLU/WH) | | 2.72 | 2.97 | 3.21 | 3.46 | 3.70 | 3.94 | 4.18 | 4.39 | 4.61 | 4.79 | 4.97 | | | | | | | |

RATING AT ARI: RETURN GAS TEMPERATURE 40° F

*Fig. 12A*

| ITEM/DESCRIPTION | | FROZEN FOOD EVAP DRAWING 102950200 |
|---|---|---|
| MODEL NUMBER | | 3EZ0808P-4.00X14.00 |
| FIN HEIGHT | (IN) | 4 |
| FINNED LENGTH | (IN) | 14 |
| ENTERING AIR DB | (F°) | -7 |
| ENTERING AIR WB | (F°) | -7.5 |
| LEAVING AIR DB | (F°) | -19.5 |
| LEAVING AIR WB | (F°) | -19.5 |
| TOTAL CAPACITY | (BTUH) | 1892 |
| SENSIBLE CAPACITY | (BTUH) | 1751 |
| AIR FLOW (STD) | (CFM) | 130 |
| FACE VELOCITY | (FT/MIN) | 334 |
| EVAPORATOR TEMP. | (F°) | -27 |
| AIR PRESSURE DROP | (IN/H2O) | 0.12 |
| REFRIGERANT | | R-404A |
| REFRIGERANT FLOW RATE | (LB/MIN) | 0.83 |
| REF. PRESSURE DROP | (PSI) | 3.08 |
| LIQUID TEMP. | (F°) | 100 |
| NO. CIRCUITS | | 1 |
| TUBES/CIRCUITS | | 100 |
| SUPERHEAT | (F°) | 6 |
| FIN STYLE | | CORRUGATED |
| FIN THICKNESS (IN) | | 0.0075 |
| FIN MATERIAL | | ALUMINUM |
| TUBE WALL THICKNESS (IN) | | 0.013 |

*Fig. 12B*

SPECIFICATIONS

| | |
|---|---|
| HEATER WIRE: | .22 ohm/ft. to 5,000 ohm/ft. Uniform Watt Density Heater Wire<br>1 ohm/ft. to 6,500 ohm/ft. Variable Watt Density and Cold Ended Heater Wire<br>1/32" Wall PVC Insulation (1/16" Available)<br>1/32" Wall Silicone Insulation (1/16" Available) |
| FOIL: | .002" Thick<br>.005" Thick<br>Both Foils Available with Vinyl Coating or Plain |
| ADHESIVE: | Rubber Based with Release Paper<br>Acrylic Based with Release Paper |
| LEAD WIRES: | #18 Stranded Copper, PVC Insulation or Silicone Insulation<br>#20 Stranded Copper, PVC Insulation or Silicone Insulation |
| CONNECTIONS: | Stapled - Mechanical, Electrical Protection Only; Not Moisture Resistant<br>Heat Seal Sleeve - Moisture Resistant, 6 W/ft. Max<br>Heat Shrink - Moisture Resistant, 6 W/ft. Max<br>Adhesive Heat Shrink - Moisture Proof, 6 W/ft. Max<br>Silicone Overmold - Moisture Proof, 15 W/ft. Max |

*Fig. 12C*

MOTOR TYPE: AC SHADED TYPE MOTOR 1 Ø 2P

| SPEC. / MODEL | SIZE (mm) | | | RATED VOLTAGE V | RATED FREQUENCY Hz | RATED CURRENT A | INPUT POWER W | SPEED RPM | MAX. PRESSURE mmAq | MAXIMUM AIR FLOW $m^3$/min | NOISE dBA | SAFETY | | | WEIGHT G |
|---|---|---|---|---|---|---|---|---|---|---|---|---|---|---|---|
| | A | B | C | | | | | | | | | UL | TUV | CE | |
| JE-03029A12 | 300 | 310 | 366 | 120 | 50/60 | 0.20/0.07 | 15/13 | 2700/3100 | 1.4/1.7 | 1.5/1.7 | 34/37 | ○ | | ○ | 670 |
| JE-03029A23 | 300 | 310 | 366 | 230 | 50/60 | 0.09/0.07 | 12/11 | 2700/3100 | 1.4/1.7 | 1.5/1.7 | 34/37 | ○ | ○ | ○ | |

| PART NUMBER | CURVE | CFM @ 0 | VAC | HERTZ* | POWER (W) | dBA | MAX AMB. TEMP C | BEARING TYPE | FEATURES | WGT. (LBS) |
|---|---|---|---|---|---|---|---|---|---|---|
| W2S130-AA25-44 | 1 | 223.6 | 115 | 60* | 38 | 53 | 80 | BALL | TERMINALS | 2.44 |

APPARATUS AND METHOD FOR SINGLE OR MULTIPLE TEMPERATURE ZONE(S) IN REFRIGERATED VENDING MACHINE

I. CROSS-REFERENCE TO RELATED APPLICATIONS

This application claims priority under 35 U.S.C. §119 of a provisional application Ser. No. 60/998,186 filed Oct. 9, 2007, which application is hereby incorporated by reference in its entirety.

II. BACKGROUND OF THE INVENTION

Vending of refrigerated items has been practiced for years in the art. Refrigerated can and bottle vendors are a well known example. A variety of configurations and methodologies have been used. Most such machines use conventional refrigeration methods and components to attempt to maintain mandated temperatures for certain food items. A conventional refrigeration unit comprises a condensing unit, evaporator, and fan to remove heat from inside the refrigerated space and circulate cooled air inside it.

Certain vendible products need refrigeration. A few examples are sandwiches, salads, and yogurt. The federal Food and Drug Administration (FDA) has laws and regulations regarding temperatures for perishable foods in vending machines (see FDA published regulations 2005 Food Code). However, not all perishable, vendible foods need the same temperature. Cold sandwiches and salads require refrigeration (e.g. in the range 33° F.-42° F.). Frozen items, such as ice cream, frozen burritos, and the like, require significantly cooler temperatures (e.g. usually at least 0° F. or colder) than cold sandwiches and salads. Because of these different requirements, one vending machine is normally used to vend frozen items and a second, separate machine is used to vend non-frozen but cold products like cold sandwiches. If also desired, a third machine would be used to dispense non-refrigerated items (e.g. potato chips, candy bars, gum, and other snacks or non-food or non-perishable items).

NAMA (National Automatic Merchandising Association standards require temperatures for refrigerated vending machines to be maintained within relatively accurate ranges. Therefore, it is not trivial to design a machine to do so. Environmental conditions at or around the machine can change drastically. Also, if the owner/operator opens the machine for maintenance or restocking, heat would normally enter the machine. Moreover, if one refrigeration unit is to be used for multiple temperature zones, this further complicates the issues. There are a number of factors, some antagonistic with each other, that may affect the ability to maintain temperature within the required range. Still further, another factor in many vending machines which complicates matters is the fact they require a drop zone from the top to the bottom in the machine. Therefore, separate temperature zones can not merely be encased and separated from one another, as is done with freezer and refrigerated sections of a household refrigerator.

However, this presents a number of issues. Cost is one. Each machine must have its own cabinet and associated structure, and, if refrigerated, a refrigeration unit. This tends to increase the number and cost of components. Floor space is another. Multiple machines normally require more floor space. Many times it is inefficient or costly use of space. Sometimes there is not room for multiple machines and therefore the customer is not allowed a fuller array of choices of vendible products. Efficient and economical use of space in the vending machine is another. Vending machines are usually designed to maximize profit, or at least maximize the number of vendible products that can fit into the machine to minimize labor costs of re-filling the machine. Space is a premium in vending machines. Normally it is desirable to have maximum space available for stocking the machine so that labor costs are reduced in restocking. Separation of the internal space of a vending machine into different temperature zones, and separate components to maintain the different temperatures, uses up internal space that otherwise might be used for products. Additionally, the margins or profit involved with vending machines are not consistent with having expensive machines with complicated components and costly manufacturing and assembly. Also, the very essence of vending machines is that they are automated. It is desirable that they essentially be left alone and work without constant supervision or checking. It is difficult to justify using interior space for insulation and equipment for multiple temperature zones which would sacrifice space for vendible products.

Despite these hurdles, a need in the art has been identified for a vending machine that can be configured for automated vending of perishables, and in particular, perishables requiring different refrigeration temperatures. A further need has been identified for a machine that can provide a variety of temperature zones. A further need has been identified for a machine which is efficient and economical. A still further need has been identified for a machine that can selectively be configured for one or more temperature zones without extensive or expensive manufacturing modifications.

An example of the application of such a machine would be a business or vending location without substantial floor space for multiple vending machines. A further example would be for a location that does not have a high volume of vending transactions but desires multiple food or product choices.

III. BRIEF SUMMARY OF THE INVENTION

The present invention relates to apparatus and methods for providing automated vending of perishable items. In one aspect, an apparatus according to the invention includes a vending machine cabinet combining an interior space for vendible products, dispenser mechanisms that can be actuated by selection of a customer, and a refrigeration unit. An inner liner material is manufactured to include a thermal break between zones in the space to deter thermal conduction through the liner between zones. A channel or duct can be installed vertically in or along the space. The channel or duct can provides a continuous air path from at or near an evaporator of a refrigeration unit at the bottom of the cabinet to an opening in the duct at the top of the cabinet, or can be divided into segments separated by insulated dividers to define two or more temperature zones within the space. At least one opening to the duct can exist in each of the defined zones. A fan can be utilized to move air from at the evaporator to a first temperature zone. A sheet or other air flow diverter can be placed appropriately within the space to direct movement of air conducive to maintaining the temperature in each zone and returning air to a fan or refrigeration unit for circulation purposes.

In another aspect of the invention, a method of maintaining multiple temperature zones within the product space of an automated perishable food vending machine comprises determining whether one or more different temperature zones is desired in the machine. If one zone is desired, an air duct is configured to move air at or near an evaporator of a refrigeration unit into the single zone. Air is circulated through the evaporator and back into the inlet of the duct at a thermostatically controlled temperature. If two zones are desired, a thermal barrier is placed between the first and second zone and the duct is configured to direct air into the first zone and circulate it back through the evaporator to create a colder temperature zone in the first zone. Controlled conduction and other techniques (e.g. stratification) are used to cool the second zone below ambient temperature but above the temperature of the first zone without having a second evaporator. Optionally, heat can be thermostatically introduced into the second zone to maintain a higher temperature than the first zone. A example would be with a foil heater. This allows a lower frozen food temperature zone and a refrigerated food temperature zone above it with one refrigeration unit and one air duct.

In another aspect, a third temperature zone can be created above the second zone by using another thermal divider or barrier. Optionally, a thermostatically controlled heater can maintain a third temperature in that zone, higher than the second zone. It could be refrigerated at a higher temperature than the second zone, or could be maintained at higher than refrigeration temperatures if, for example, non-perishables are to be dispensed.

Thus, the invention relates to a vending machine that can be efficiently configured (or reconfigured) into a single or multiple temperature zone vending machine utilizing a single refrigeration unit. In a three zone configuration, it can store and vend perishable frozen food items from the bottom zone and dispensing mechanisms and trays, perishable cold food times in a middle zone, and ambient snacks in a top zone. Temperature separation between zones is achieved via thermal breaks, air curtains, insulated divider(s), and natural stratification. The machine can be configured for one temperature zone, or two, or possibly three or more. Temperatures in the upper zones are regulated. In one example the regulation is by controlled conduction and electric foil heater (s) to maintain temperatures in accordance with standards or regulations. This allows different temperature items (e.g. frozen food, cold food, and ambient snacks for a three zone machine) to all be stored and vended out of the same machine, replacing the two or three separate machines that otherwise would be required. The invention also allows a standardized set of starting components that can be configured or reconfigured into a single or multi-temperature-zone machine by efficient and economical steps.

IV. BRIEF DESCRIPTION OF THE DRAWINGS

FIGS. 8A-D are enlarged diagrammatic views illustrating the functional principle of selective positioning of a thermal insulating divider into the air duct.

Figure 9:
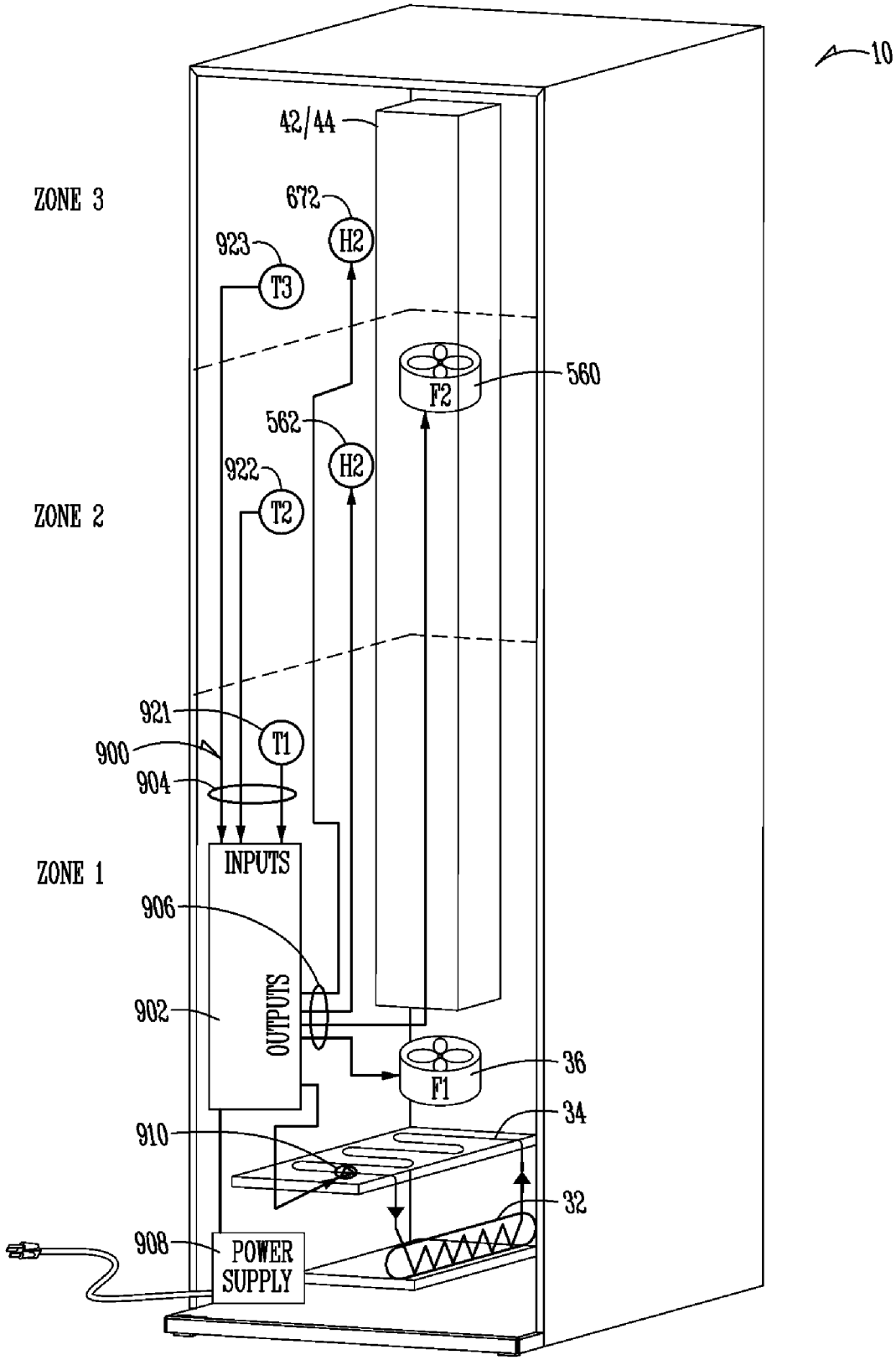

FIG. 9 is a diagrammatic depiction of electrical circuitry for maintaining one or more temperature zones in the machine.

Figure 10A:
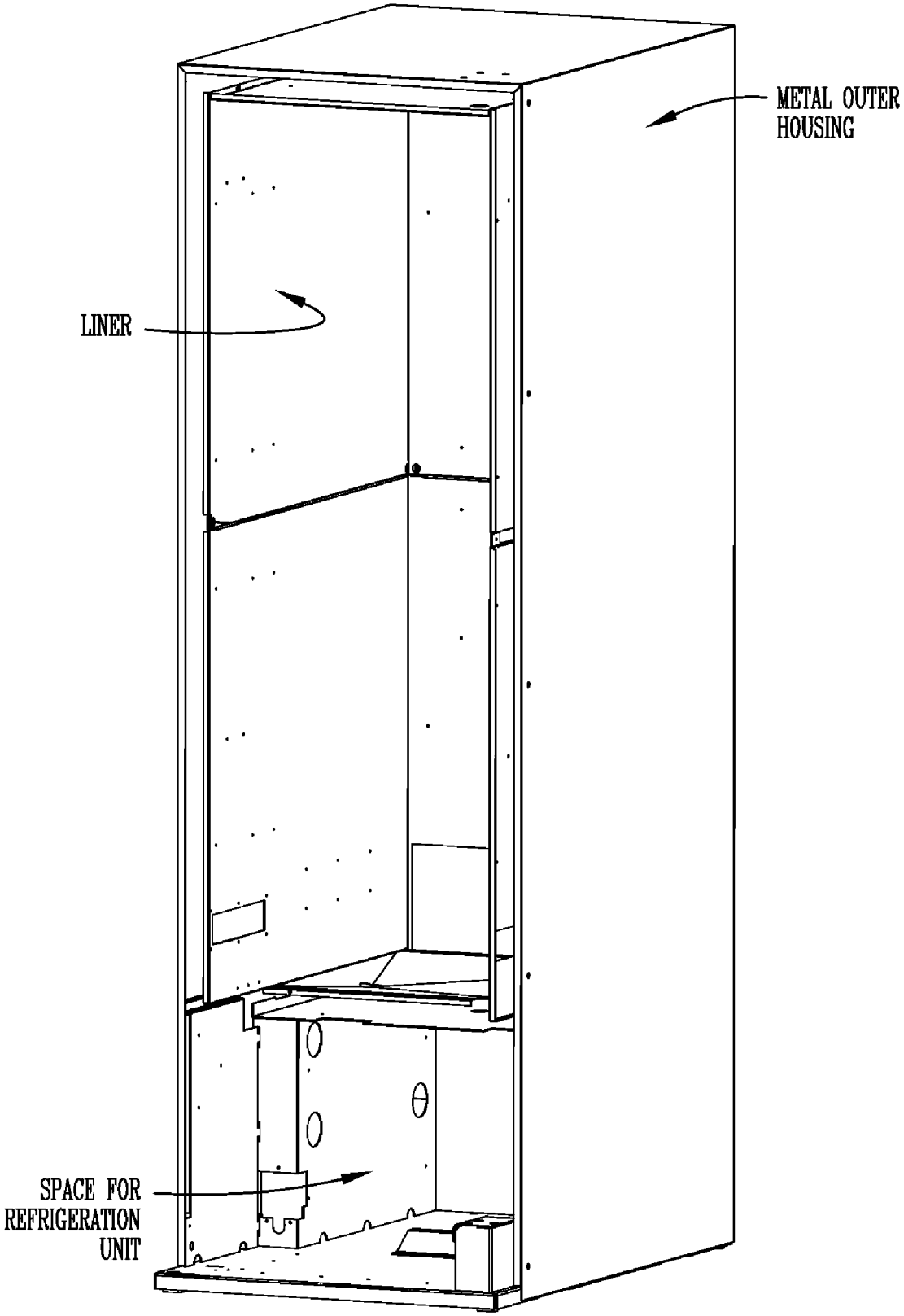
Figure 10B:
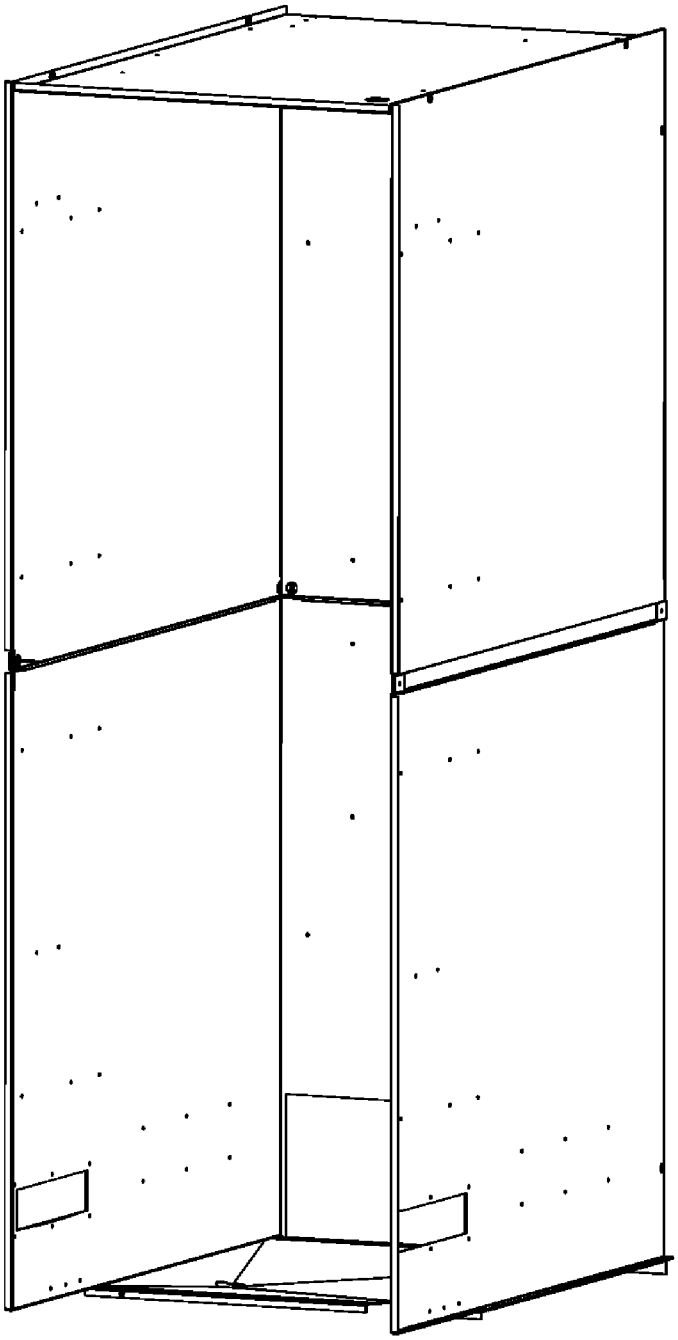
Figure 10C:
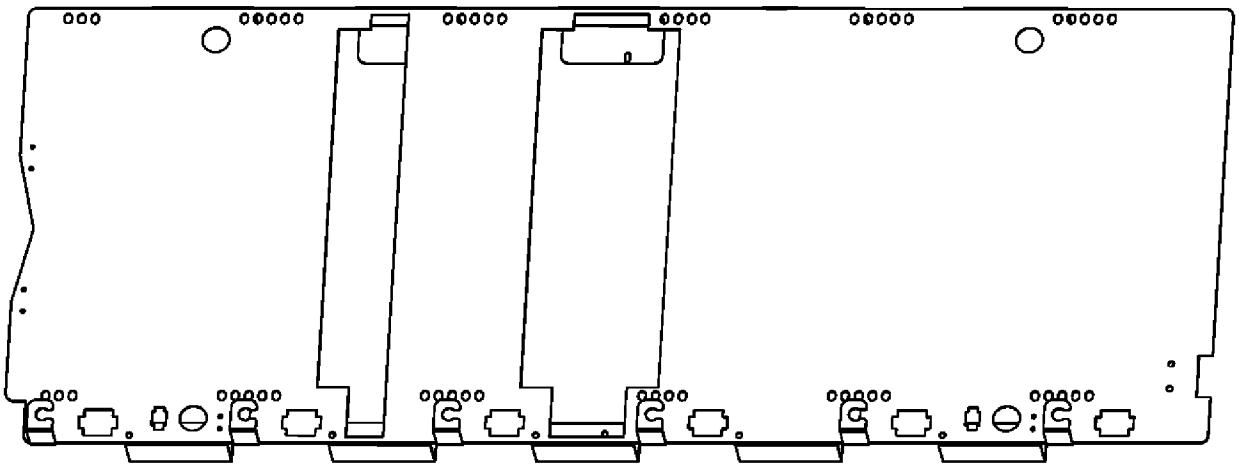
Figure 10D:
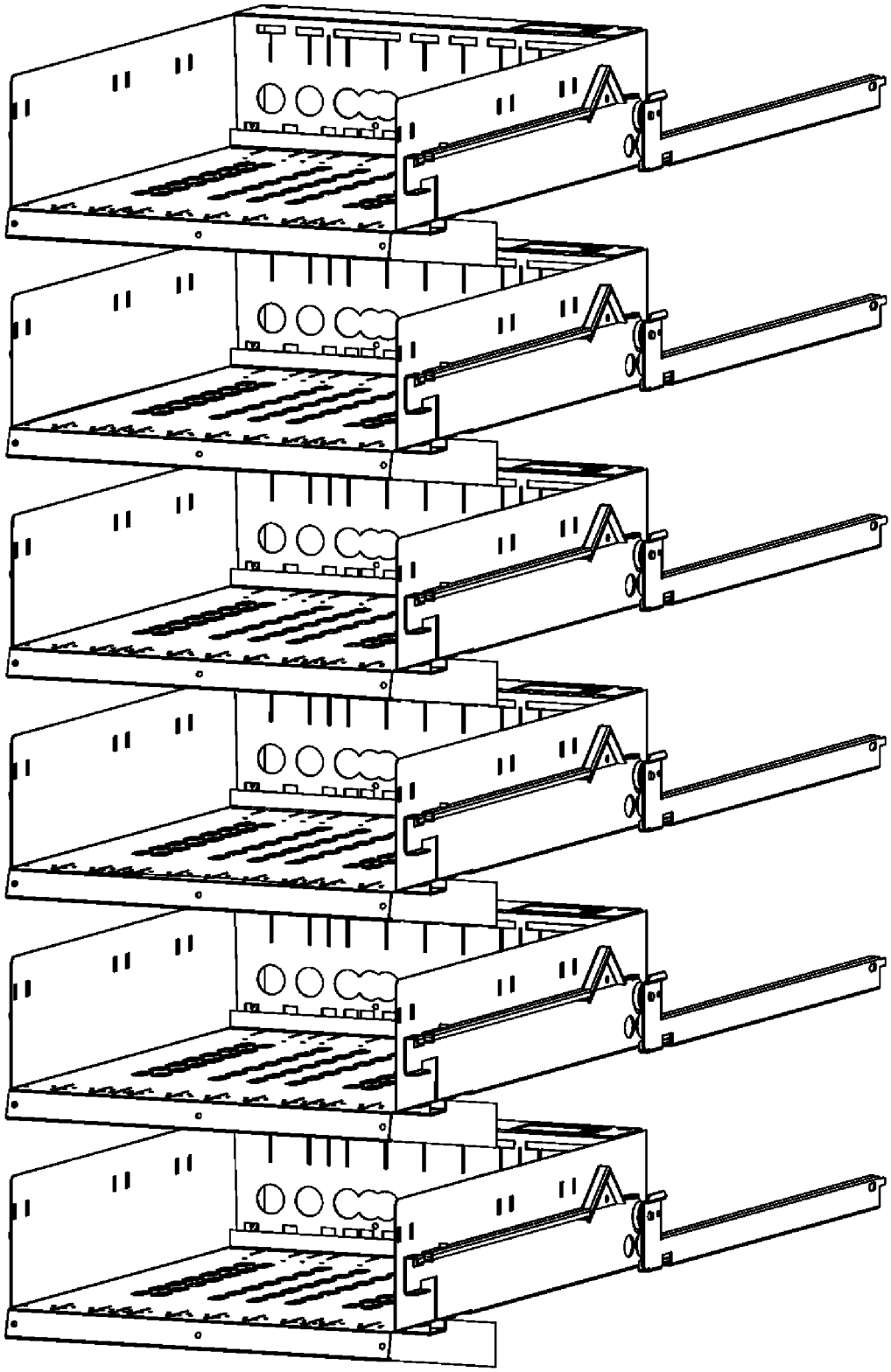
Figure 10E:
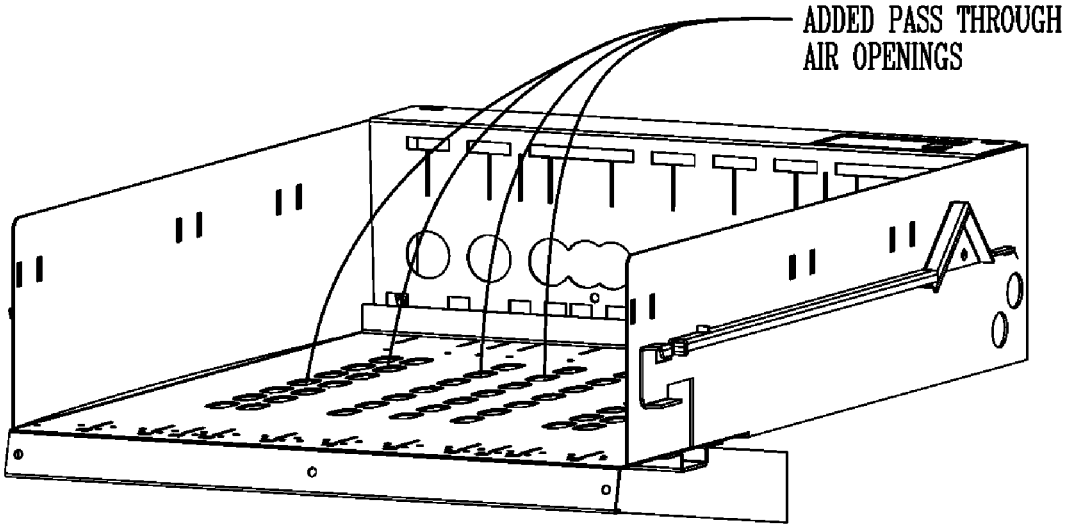
Figure 10F:
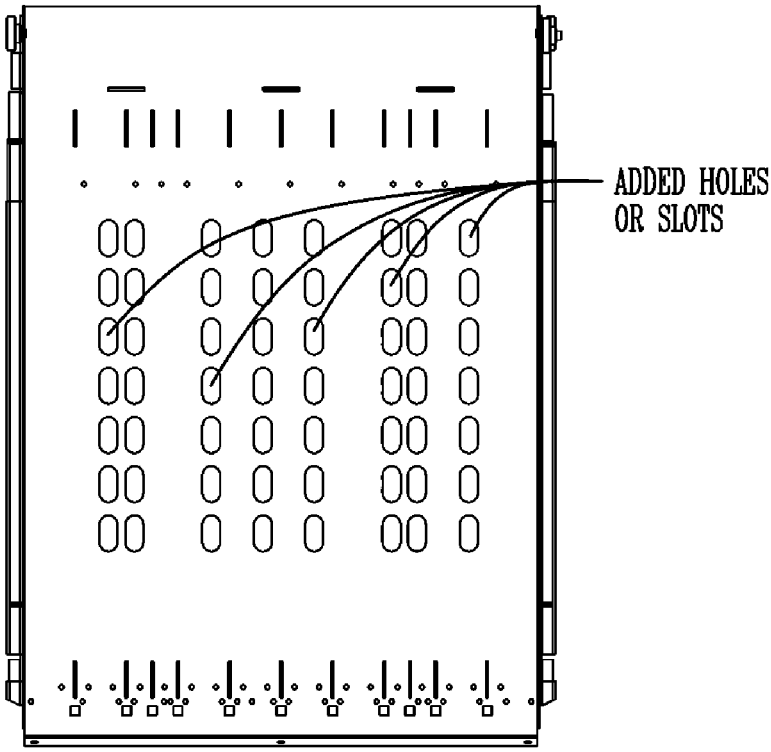
Figure 10G:
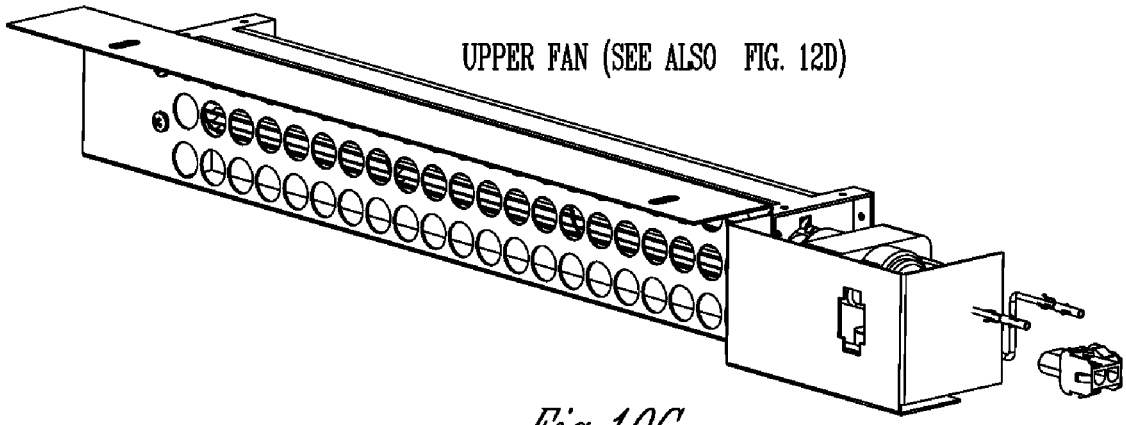
Figure 10H:
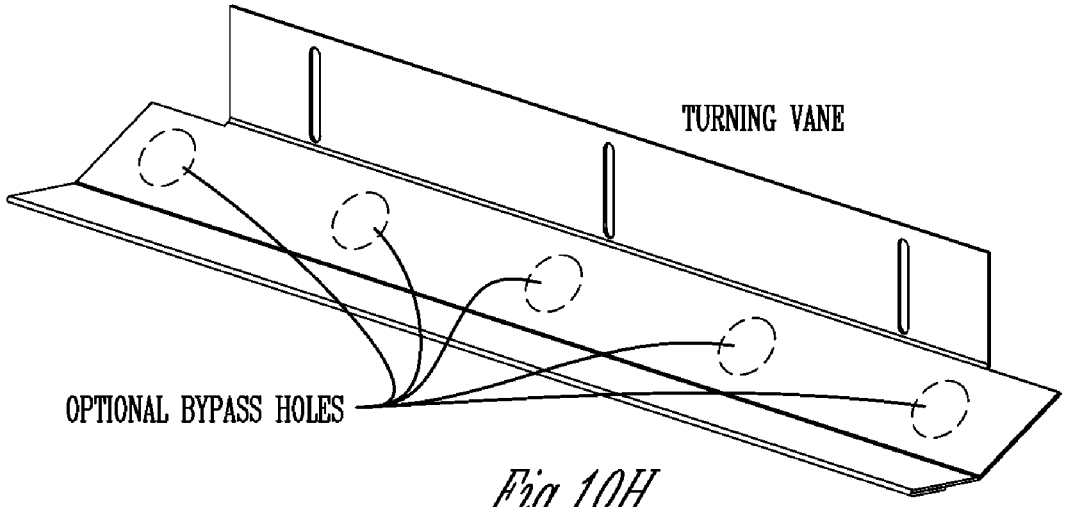
Figure 10I:
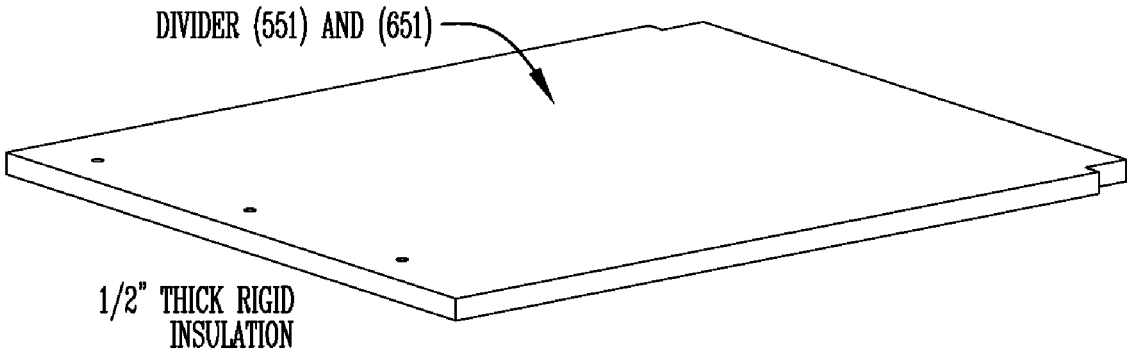
Figure 10J:
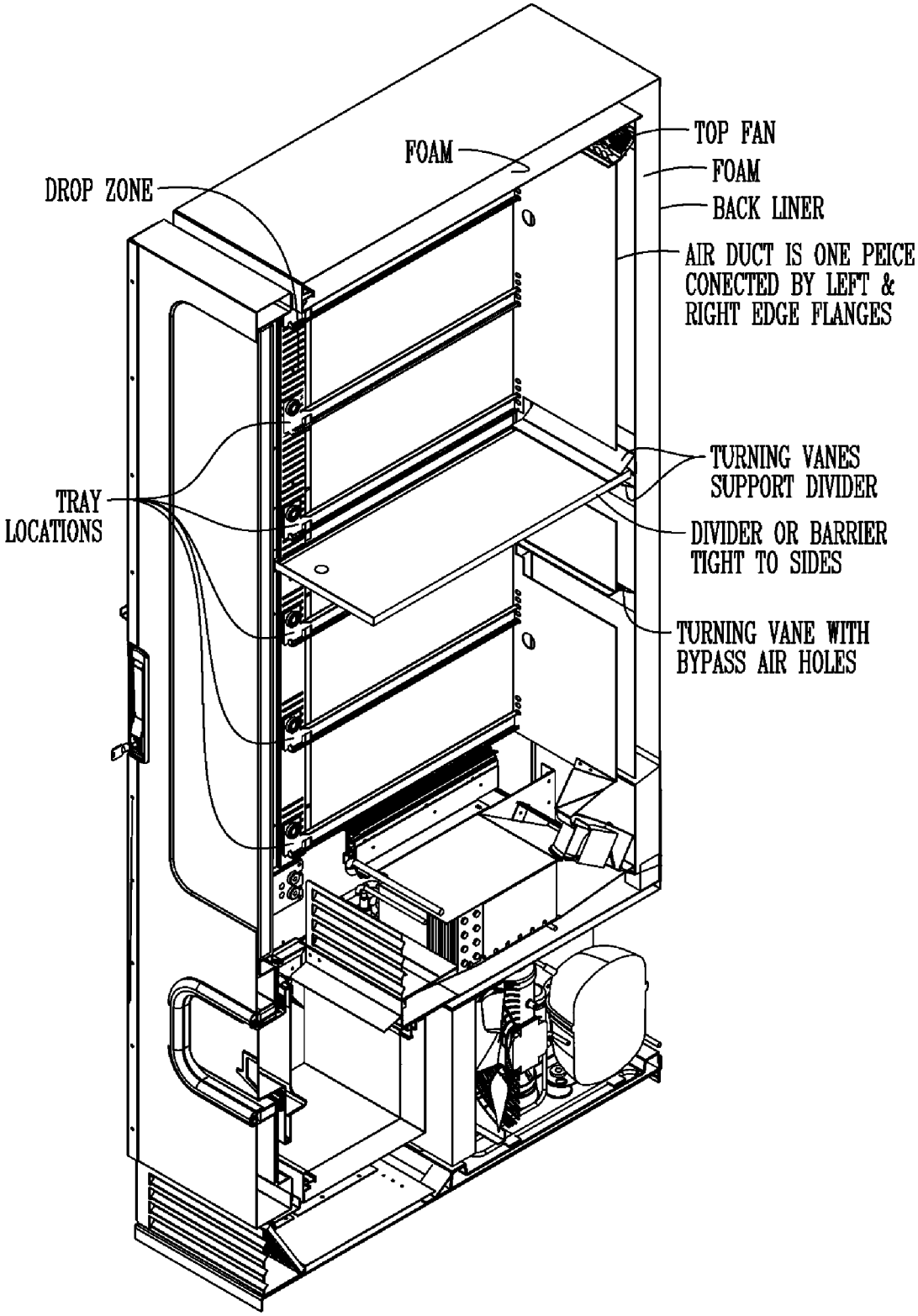
Figure 10K:
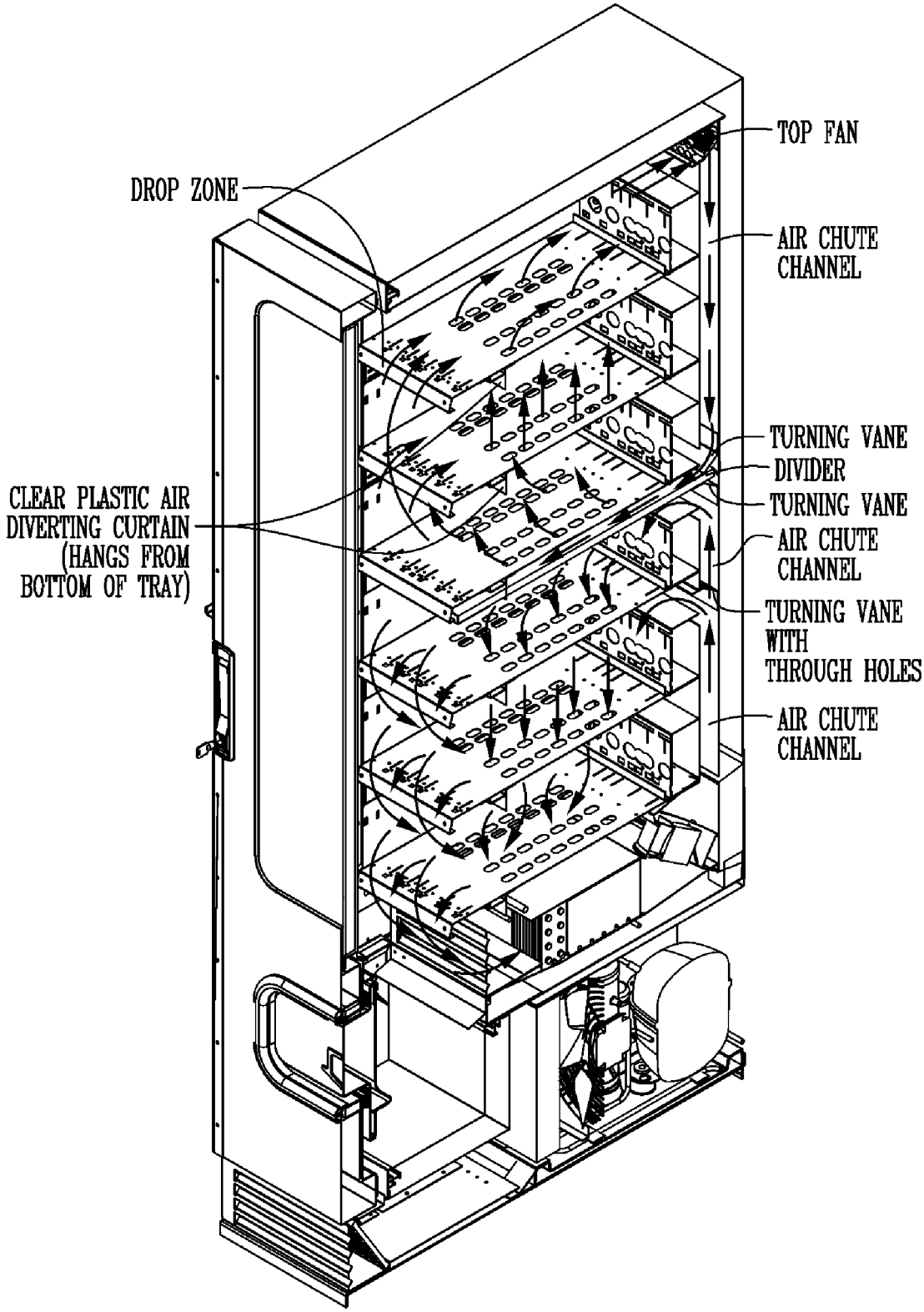
Figure 10L:
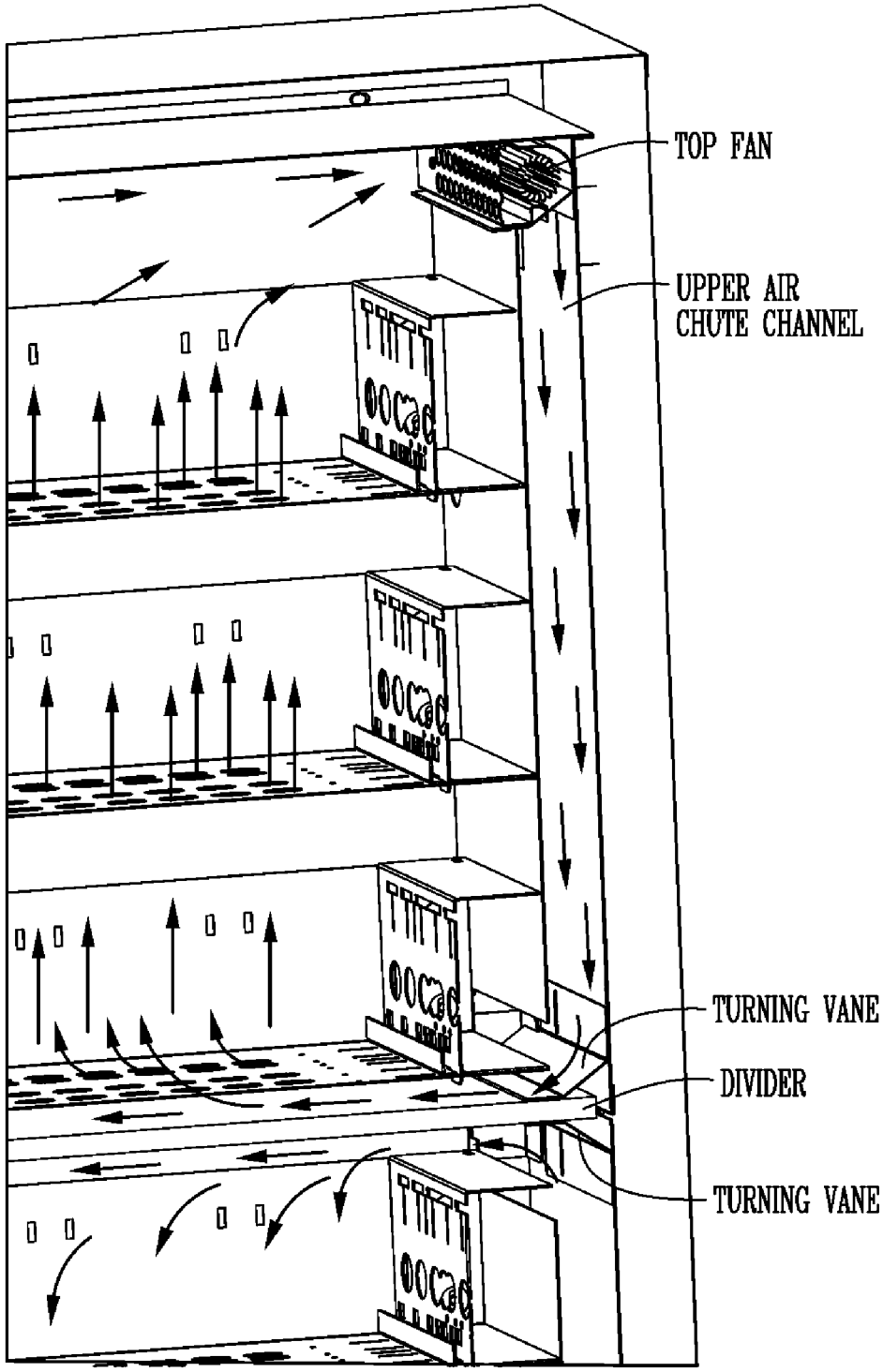
Figure 10M:
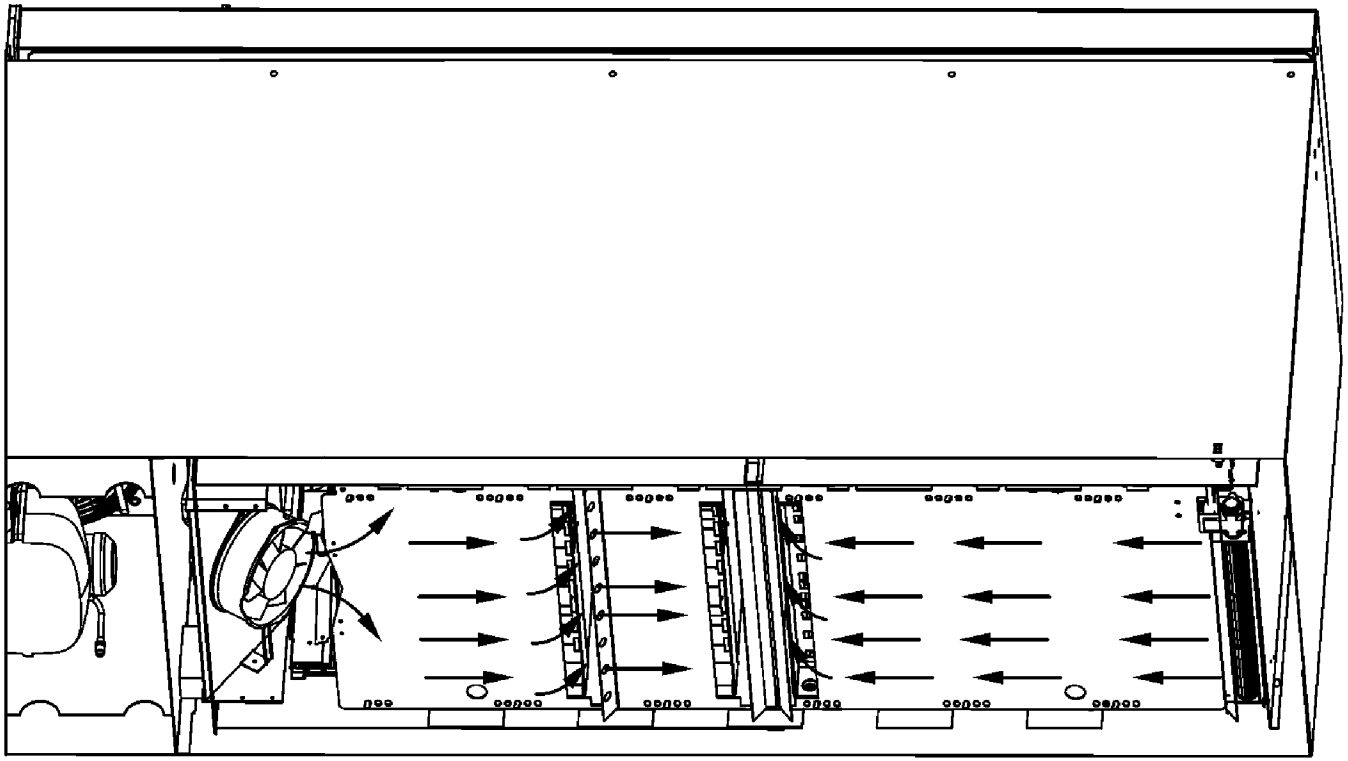
Figure 10N:
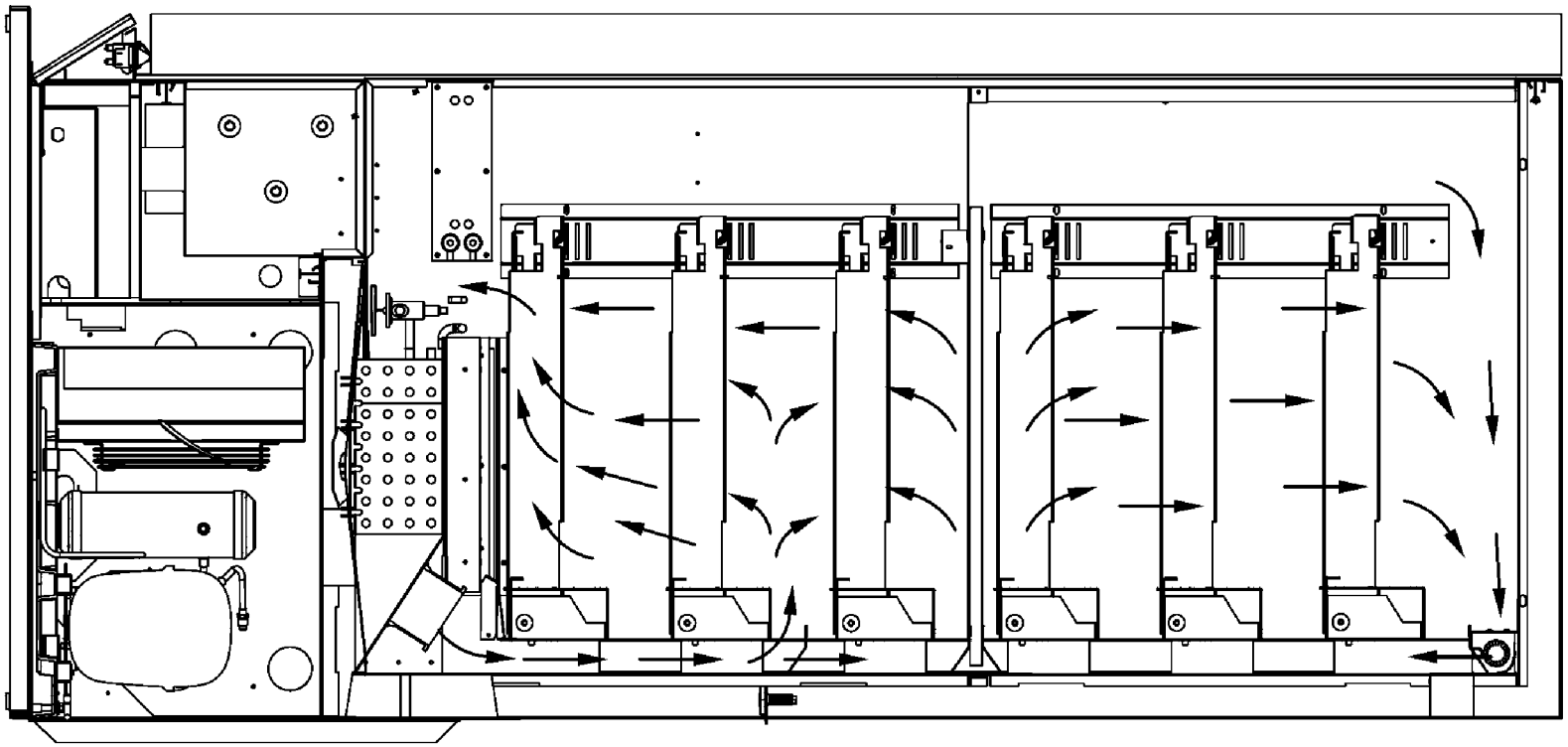

FIGS. 10A-N are isolated, sectional, or assembled views of components used to construct the different embodiments of the machine.

Figure 1A:
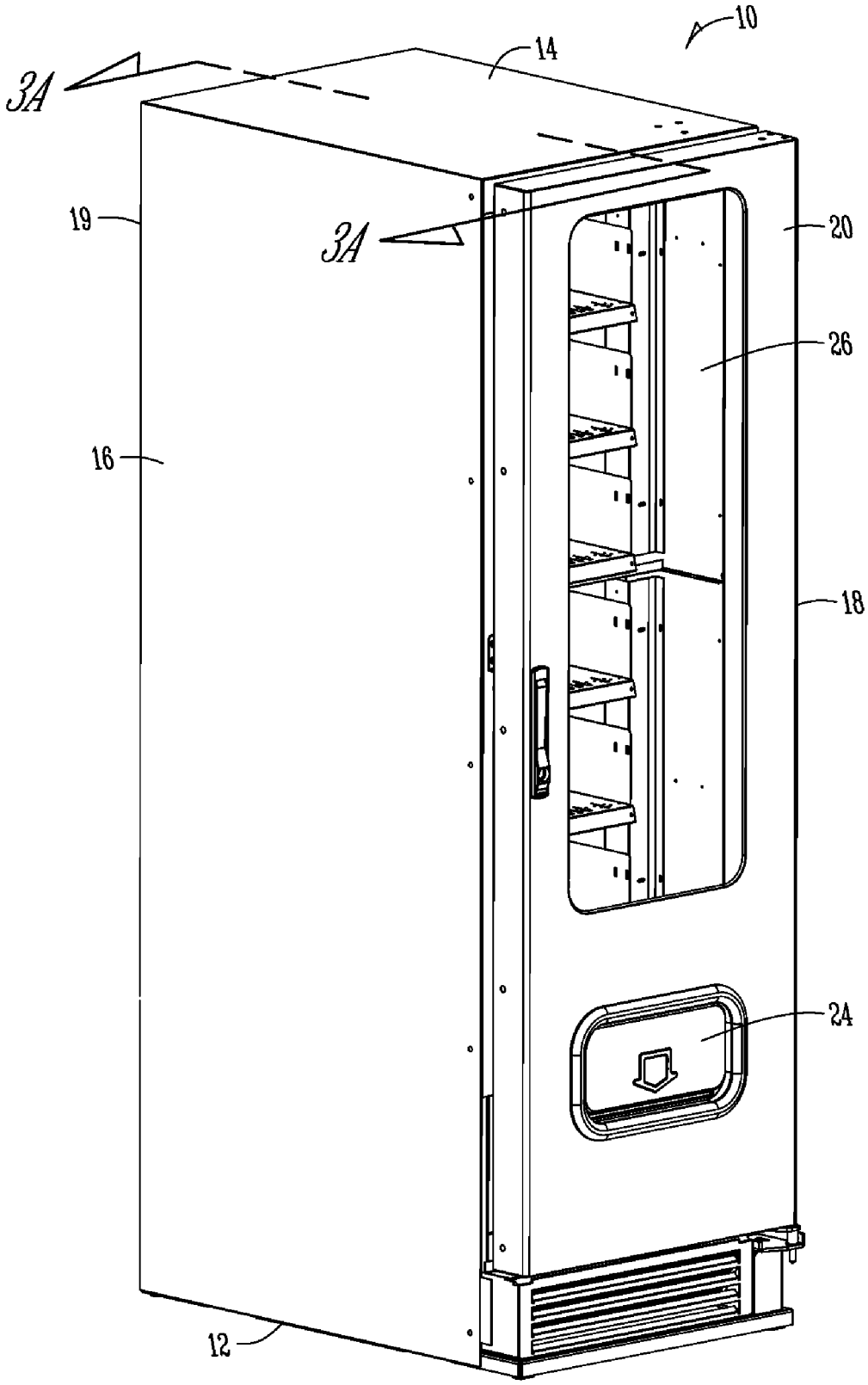
FIG. 1A is a diagram of a perspective view of a conventional refrigerated vending machine with a glass front window to view vendible items in multiple vertical trays of vending dispensers.
Figure 1B:
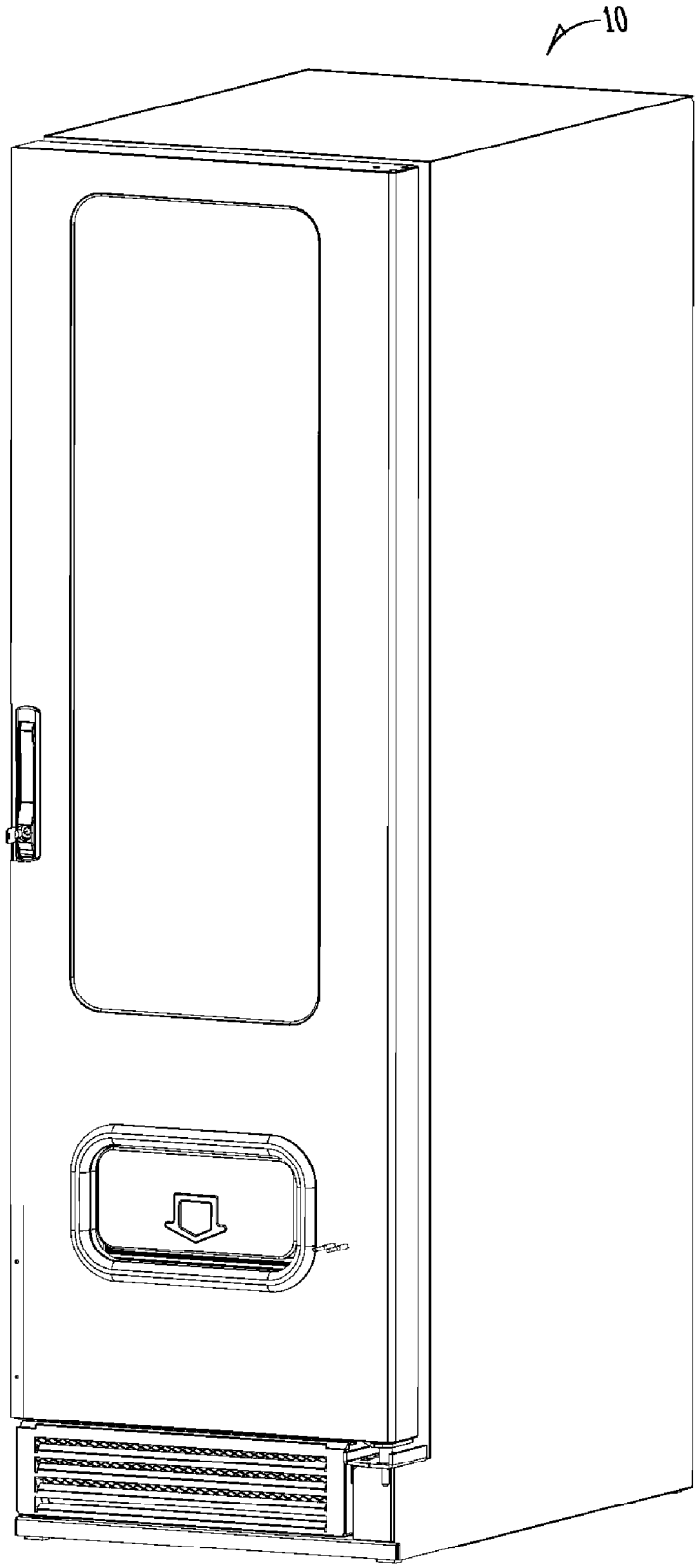
FIG. 1B is a perspective drawing of a machine like that of FIG. 1A.
Figure 1C:
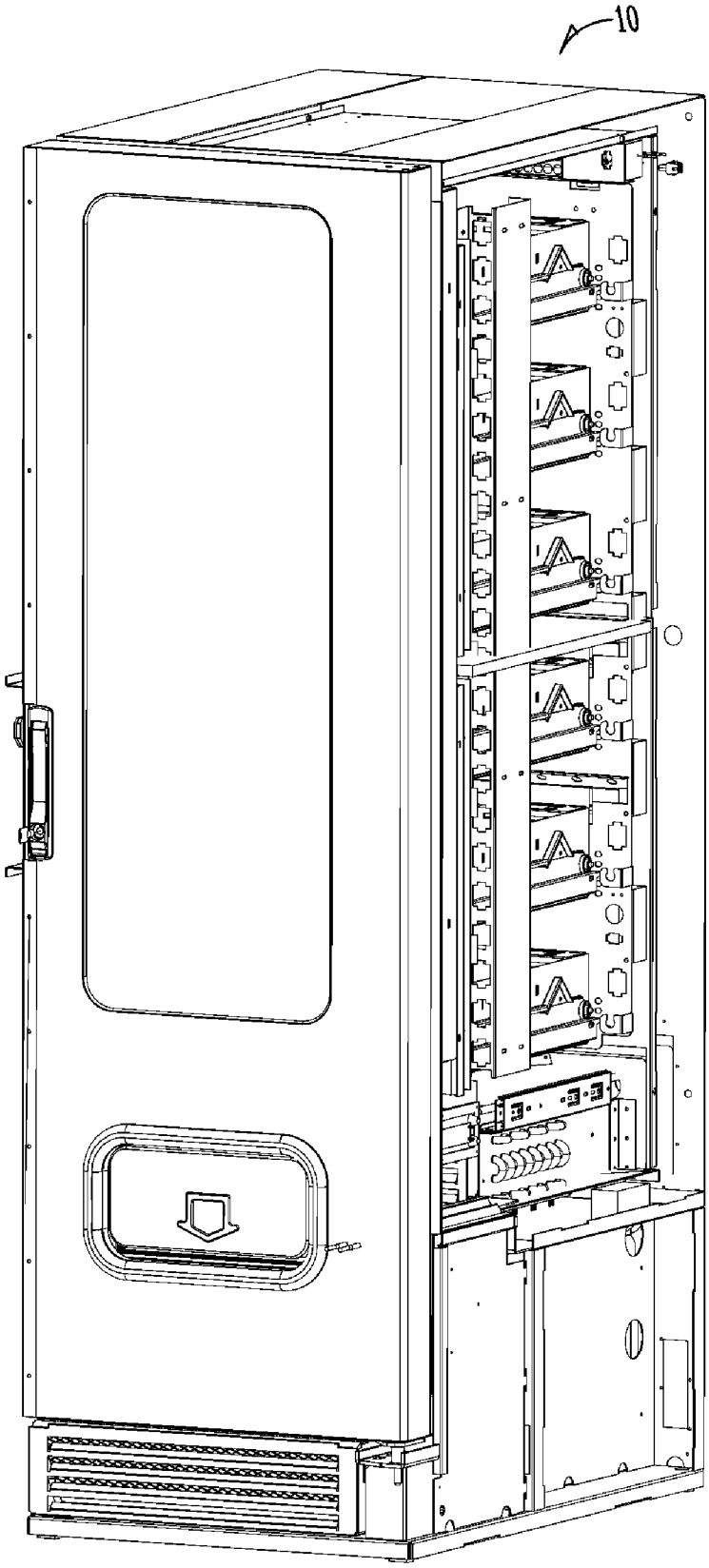
FIG. 1C is similar to FIG. 1B but shows some interior parts of the machine.
Figure 1D:
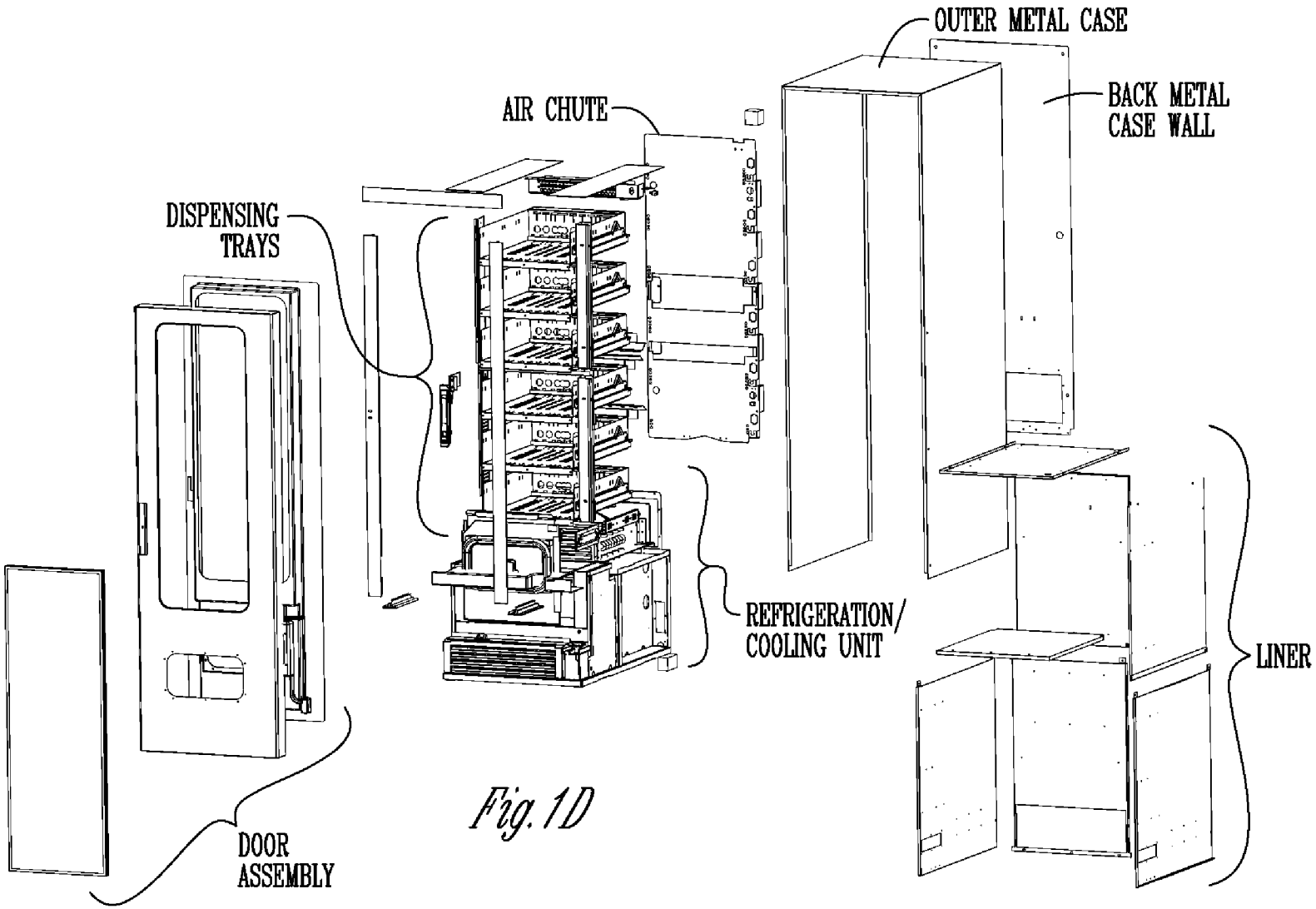
FIG. 1D is an exploded view of FIG. 1C.
Figure 1E:
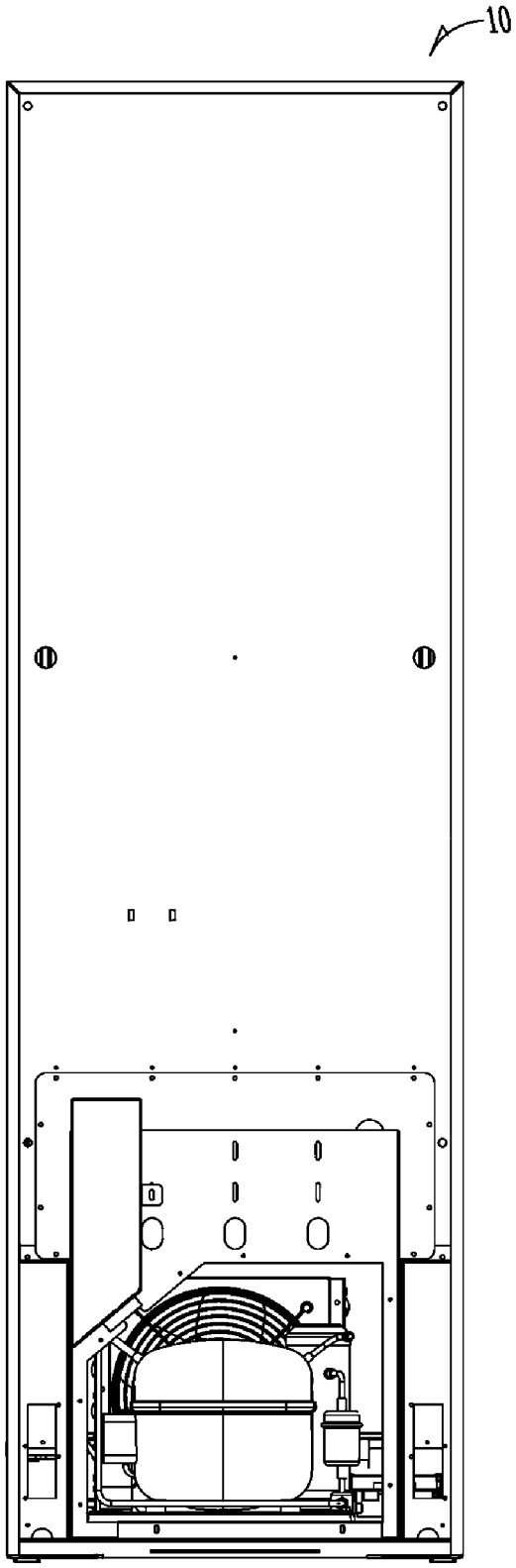
FIG. 1E is a back elevational of FIG. 1B.
Figure 2:
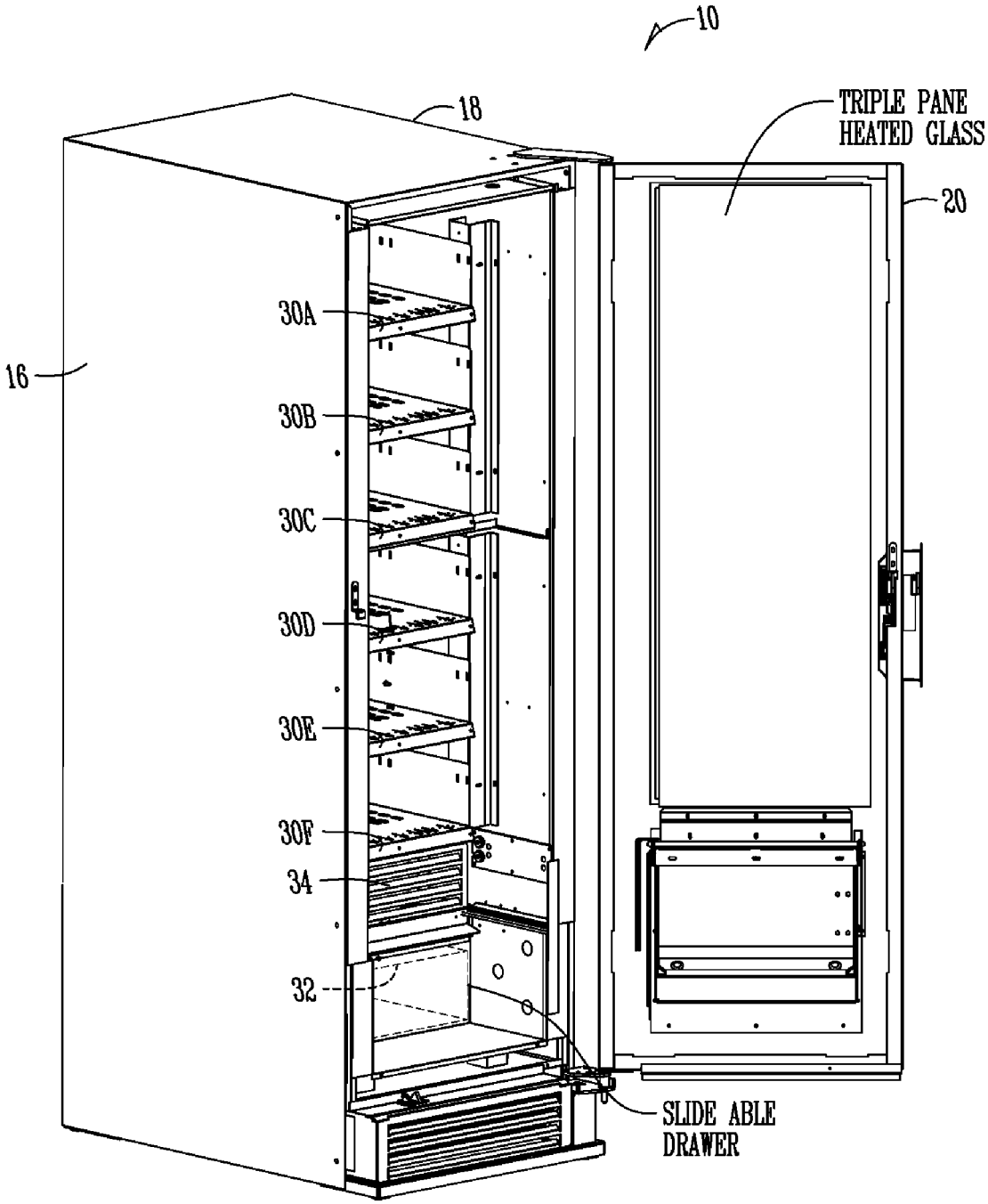
FIG. 2 is a perspective view of the refrigerated vending machine of FIGS. 1A-1E with its front door pivoted open.

FIGS. 11A1-2 show a flow chart of operation of the machine.

FIG. 11B is a chart of design rules to size components for an embodiment of the machine.

Figure 11C:
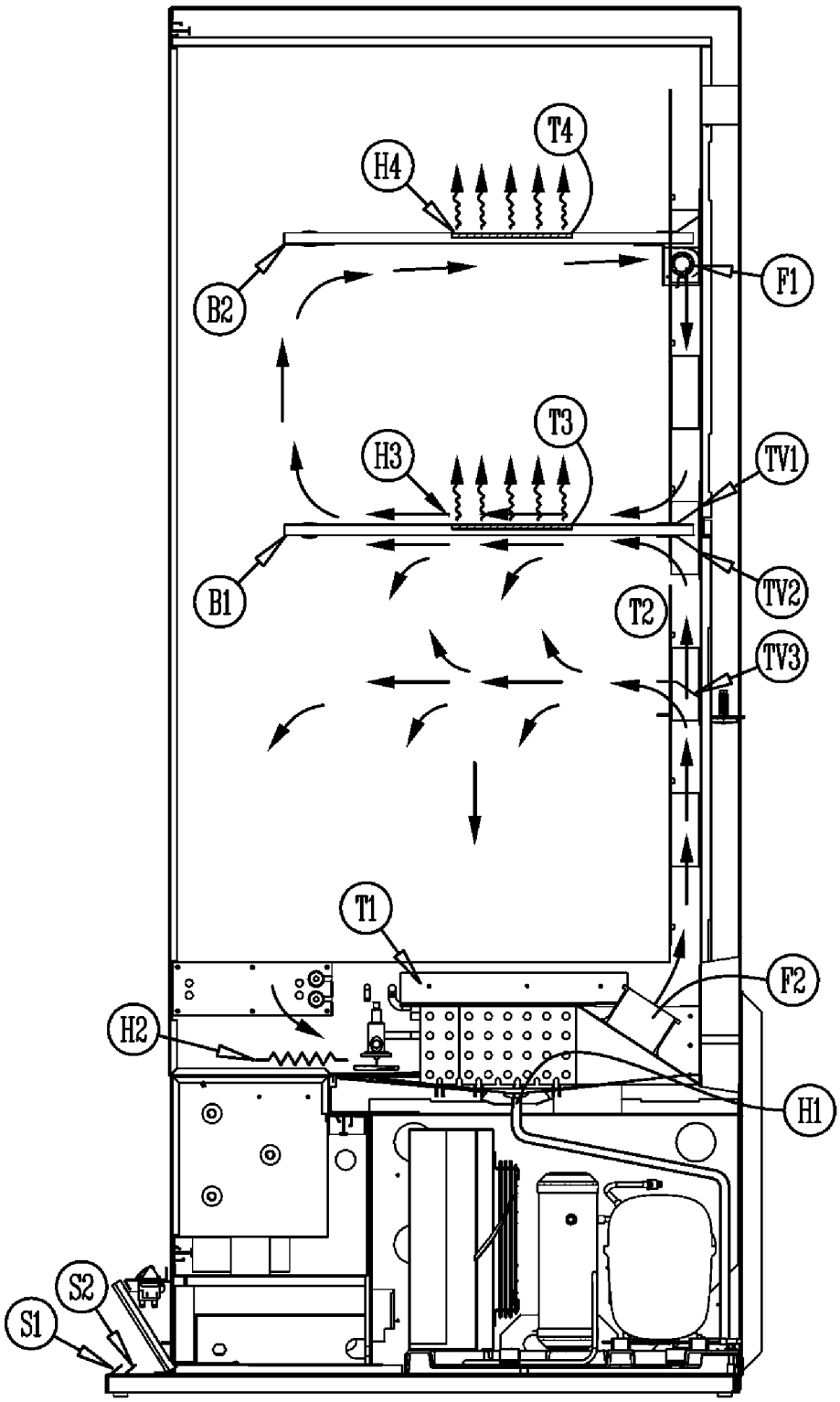

FIG. 11C is a diagram of a sectional view of a three zone embodiment with control description describing how temperature in each zone would be maintained.

FIGS. 12A-E are charts illustrating exemplary operating parameters of the indicated components of the machine.

V. DETAILED DESCRIPTION OF THE PREFERRED EMBODIMENT

A. Overview

For a better understanding of the invention, several embodiments will now be described in detail. It is to be understood this is but one example of forms the invention can take for illustration purposes only.

B. Conventional Refrigerated Vending Machine—FIGS. 1 and 2

The exemplary embodiments will be described in the context of an automatic merchandising machine having conventional attributes of a satellite automated merchandising machine such as electrical or electronic dispensers, all within a cabinet with a lockable front door. It would be operably connected to a host machine with such things as coin acceptor/changer and/or bill validator, and a programmable electronic controller that controls operations of the machine. Trays or product storage shelves are installable into the interior space of the machine. A conventional refrigeration unit (condenser 32, evaporator 34, and fan 36) are also used.

FIGS. 1A-E illustrate the general components of a conventional vending machine 10. The outer cabinet includes a base or bottom 12, a top 14, a left side 16, right side 18, back 19, and front door 20. Lockable door 20 is pivotally openable (see FIG. 2) and has a window 26 for viewing the interior contents of the vending storage space. Multiple trays 30A-F are positioned in vertical relationship inside the cabinet. Each tray 30A-F has multiple front to back sleeves with dispensing mechanism that can be electrically activated to dispense a product in the sleeve if selected through the front control panel 28 by a customer. An example of these types of components can be seen at U.S. Pat. Nos. 5,570,811 and 5,791,516 to Wittern, Jr. et al., which are incorporated by reference herein. One new feature of the trays (see FIGS. 10E and F), is that air holes have been added to help disperse air flow evenly over the products in the tray).

At the bottom of the cabinet is a refrigeration unit of conventional components including a condensing unit 32, an evaporator 34, and a bottom fan 36. The cabinet of vending machine 10 is appropriately insulated. Examples of such conventional components are disclosed at U.S. Pat. No. 4,977,754.

C. Base Unit for Exemplary Embodiments of the Invention—FIGS. 3A-C

Figure 3A:
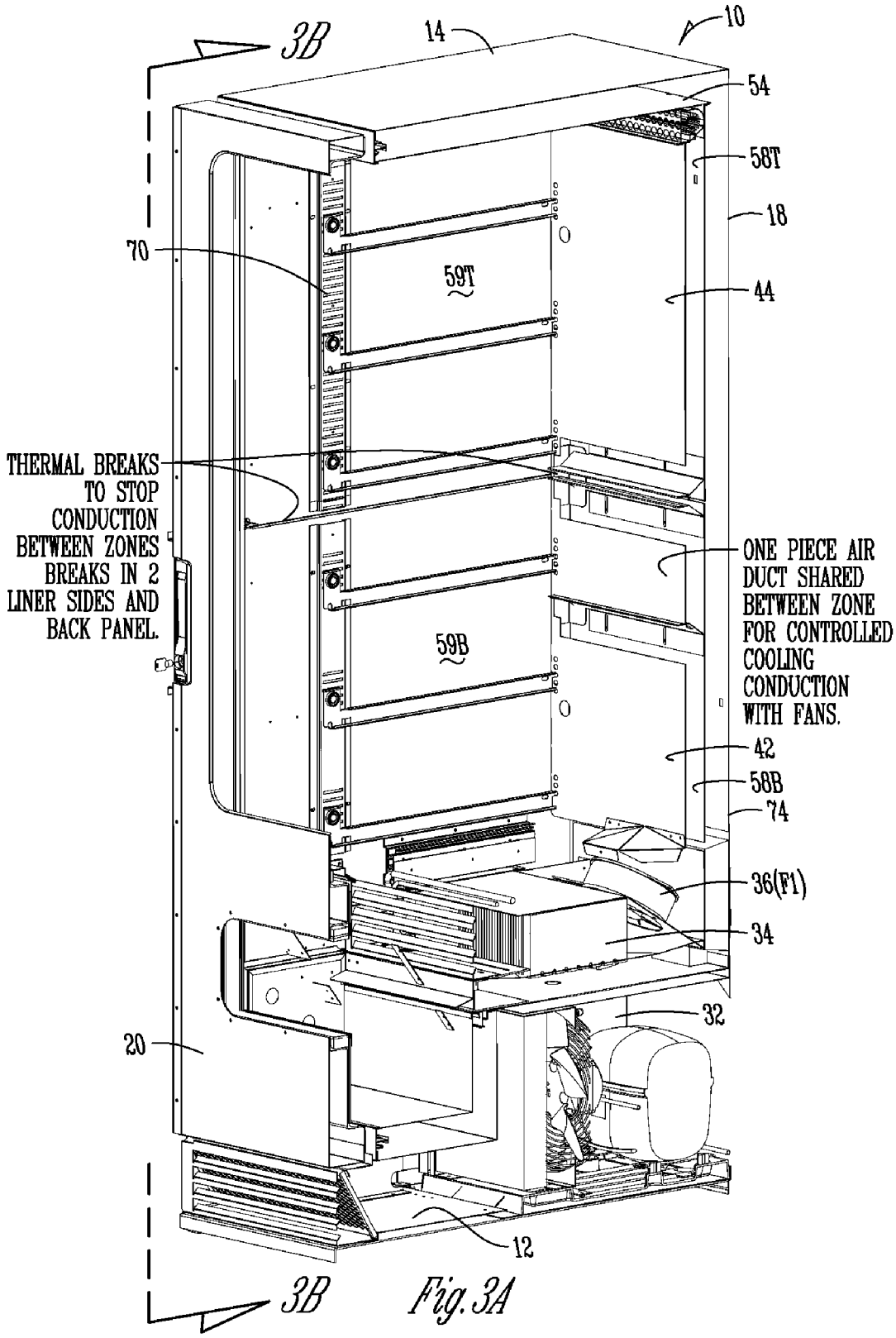
FIG. 3A is an enlarged sectional view of the interior of the machine of FIG. 1A taken along line 3A-3A of FIG. 1A with trays and dispensers removed, and showing a basic preliminary starting structure for assembling either a single or multiple temperature zone refrigerated vending machine according to exemplary embodiments of the present invention.
Figure 3B:
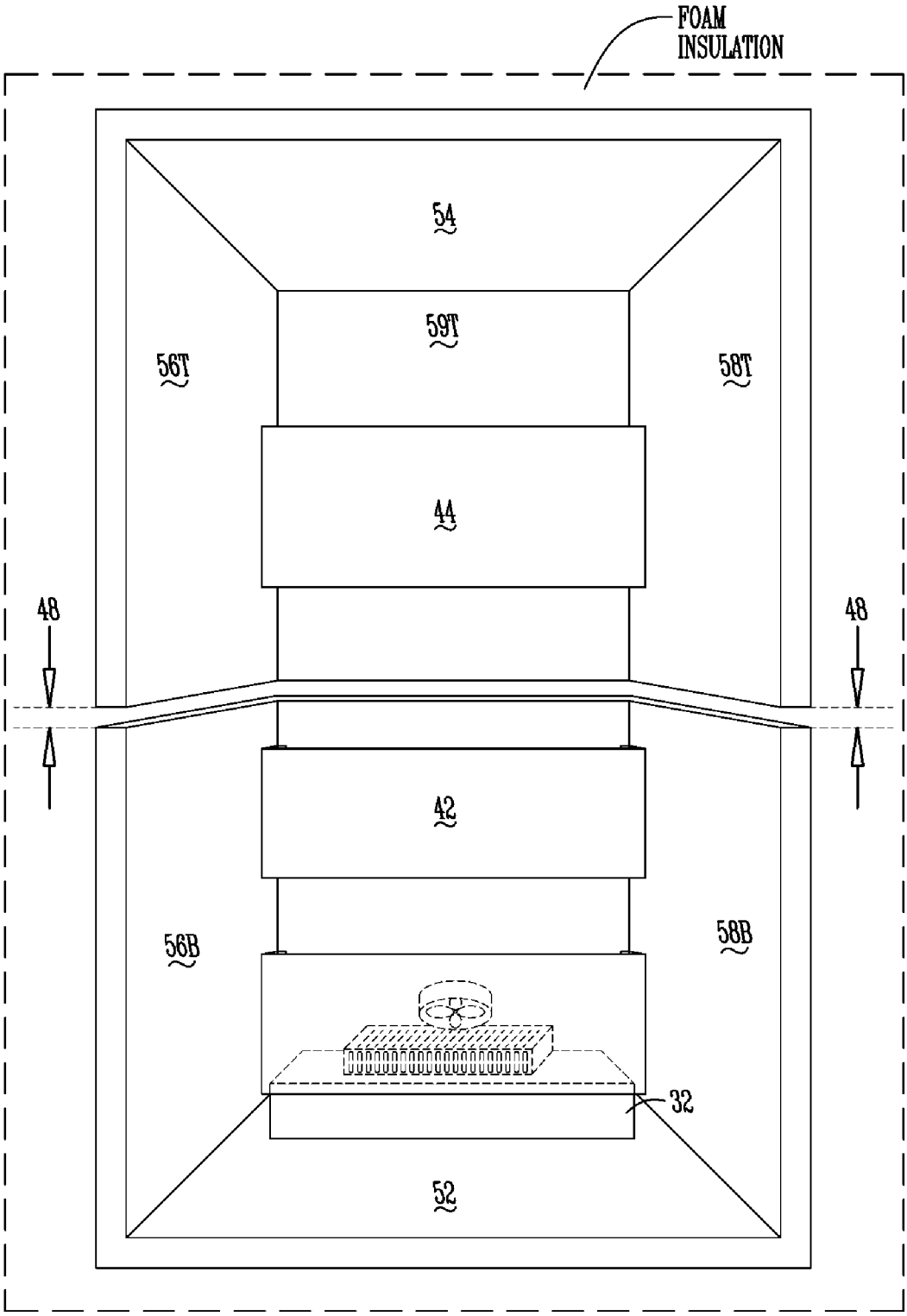
FIG. 3B is a diagrammatic simplified depiction of the interior of the portion of the partially assembled machine shown in FIG. 3A, but from the front without the door and showing the entire width of the machine.
Figure 3C:
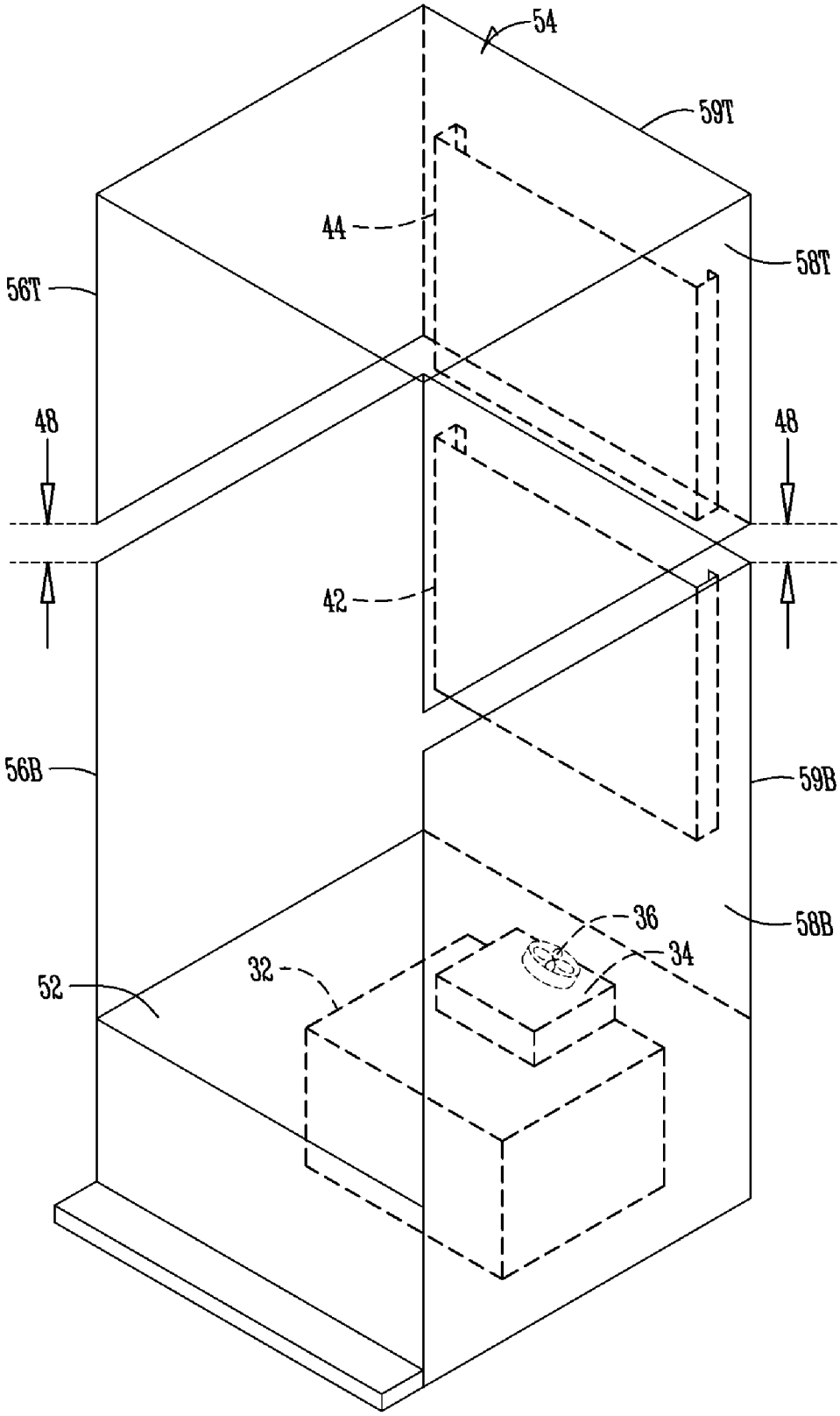
FIG. 3C is similar to FIG. 3B but from a different perspective.

FIGS. 3A-C illustrate the interior of machine 10, but partially modified according to an exemplary embodiment of the present invention, into what will be called a base unit. Storage space for the vendible products is defined by inner liner walls, specifically bottom liner wall 52, top liner wall 54, back liner wall 59, left side liner wall 56 and right side liner wall 58. The liner walls can be made of sheet metal, thin plastic, or other materials commonly used in refrigerated interiors.

Evaporator 34, condenser 32, and bottom fan 36, and related components for a complete refrigeration unit, are positioned in an appropriate enclosure near the bottom of the inner liner space and centered in the back of machine 10. Note that appropriate mounting structure (see reference numerals 70 and 72) is shown to indicate where trays 30A-F (and dispensers) could be mounted at adjustable heights within unit 10. FIGS. 3A-C do not show trays 30A-F for clarity in describing and illustrating aspects of the exemplary embodiment.

The base unit also features a drop zone in the front of the interior space. This drop zone allows vendable products to fall from the shelves to the dispensing location. The drop zone also allows for air communication between various portions of the base unit.

As can be seen, the base unit is essentially modular. It allows efficient configuration of a machine 10 in any of the models described below. Note also how each model uses just one refrigeration unit. The base unit illustrated in FIGS. 3A-C has the following important aspects.

1. Thermal Break in Liner

A thermal break 48 is created in the liner to essentially segregate a top half of the liner (54, 56T, 58T, 59T) from a bottom half of the liner (52, 56B, 58B, and 59B) (see FIG. 10B). Break 48 essentially is a physical gap between adjacent parts of the top and bottom halves of the liner. When the liner is installed, this deters any thermal conductivity of heat between the top and bottom panels of the liner. This provides a starting point from which machine 10 might be configured as a multiple temperature zone machine.

2. Single Air Duct with Gap Coordinated with Thermal Break

Secondly, an air duct is installable along the back part of the liner (although it could take different positions inside the liner, between the liner and the outer cabinet wall, or perhaps even outside the cabinet wall). It has one end at or near the evaporator 34 and an opposite end at or near the top of liner 54. This duct is configured to provide a direct air path to move cold air away and vertically upward from evaporator 34 by fan 36. The air duct is formed from a single piece (see FIG. 10C) that mounts to the inside of the back wall of the liner. The back wall of the liner functions as the back wall of the air duct to utilize the thermal break. One or more gaps (see FIGS. 3C and 10C) exist along the air chute piece length coincident. One (gap 46) is coincident with thermal break 48. As will be appreciated by reference to the following description, gap 46 can either be closed (by adding an insert to make a continuous single air duct bottom to top) to present basically an uninterrupted air duct from at evaporator 34 to the top of machine 10 for a single zone machine (see FIGS. 4A-C), or one or more dividers can be inserted to block the duct at location 46 for a two or more zone machine (as will become apparent with reference to FIGS. 5A-C and 6A-C).

The single air chute and top fan provide cooling throughout machine 10 by thermostatically controlled circulation of cold air from the evaporator up the air chute and out and across the top of the machine 10. The cold air would fall by known principles of physics. Fan 36 would assist in creating circulation and recirculation. Also, the metal air chute would also promote some cooling in machine 10 by conduction through the metal.

Thus, FIGS. 3A-C illustrate how the base unit can essentially be ready for either a single temperature zone configuration for machine 10 or at least two temperature zone configuration for machine 10.

D. Base Unit Modified to Single Temperature Zone Configuration—FIGS. 4A-C

Figure 4A:
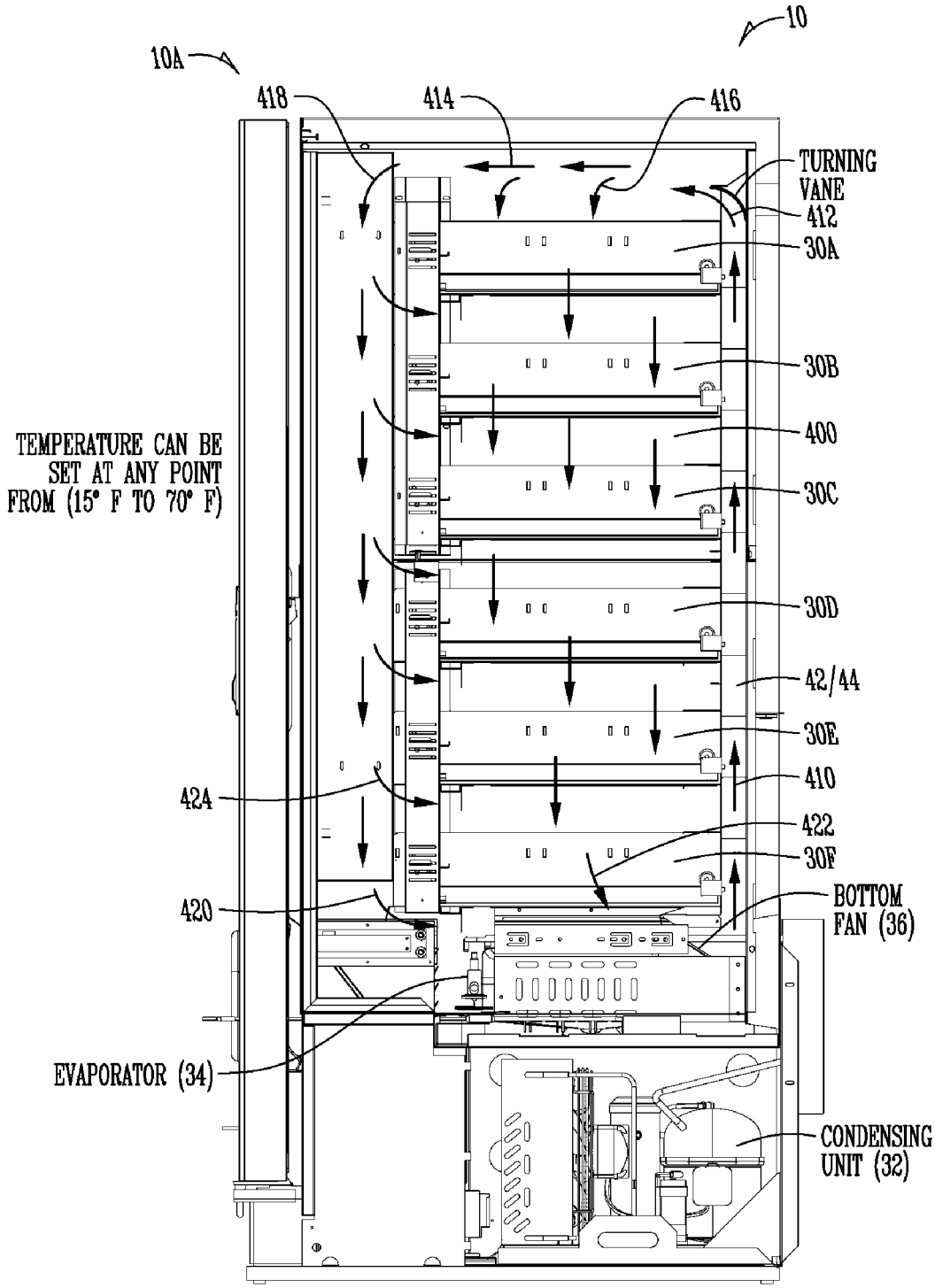
FIG. 4A is similar to FIG. 3A, but shows an assembled machine with one refrigerated temperature zone.
Figure 4B:
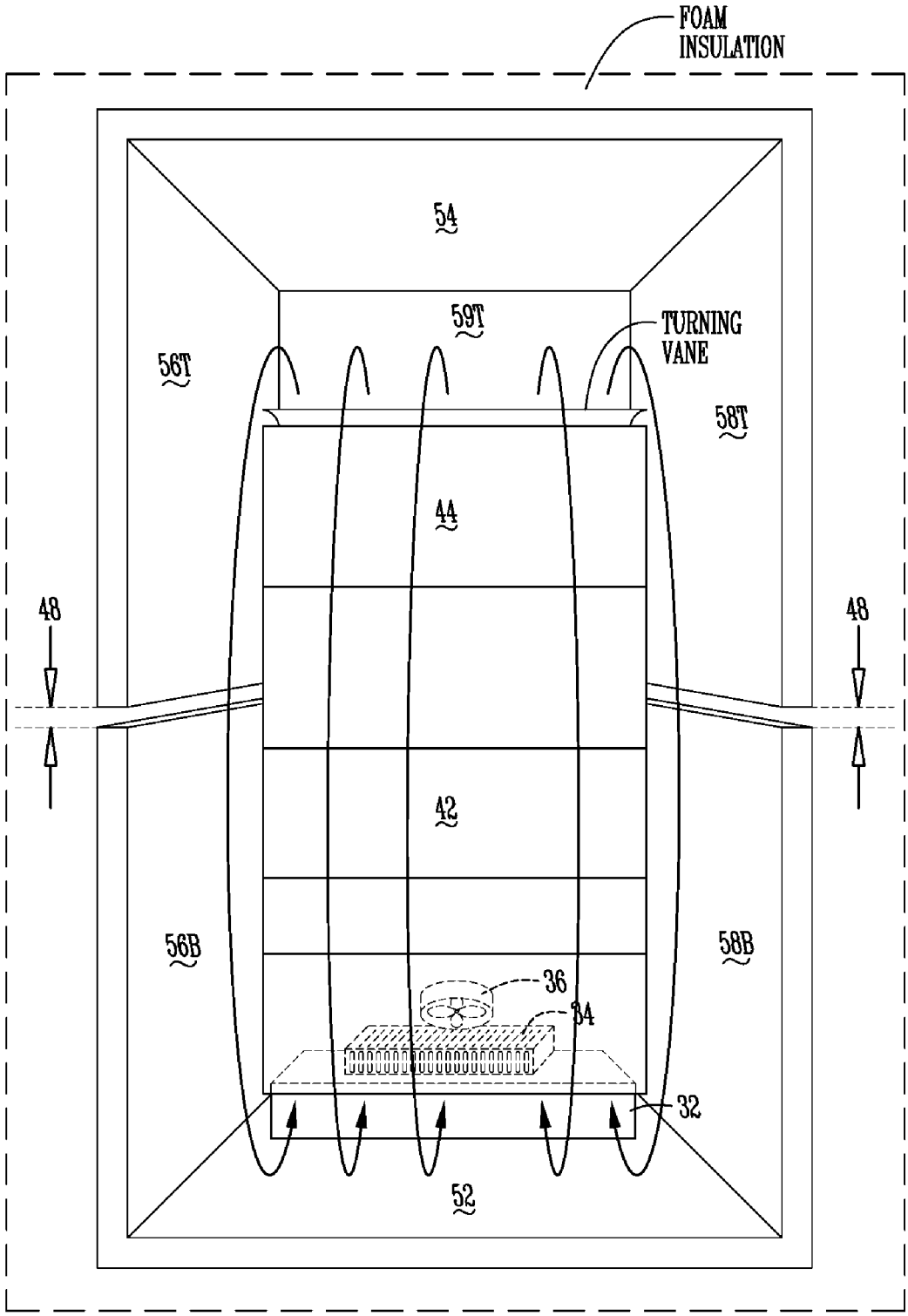
FIG. 4B is similar to FIG. 3B but illustrates modifications to the basic interior of FIG. 3B to convert it to the single temperature zone machine of FIG. 4A.
Figure 4C:
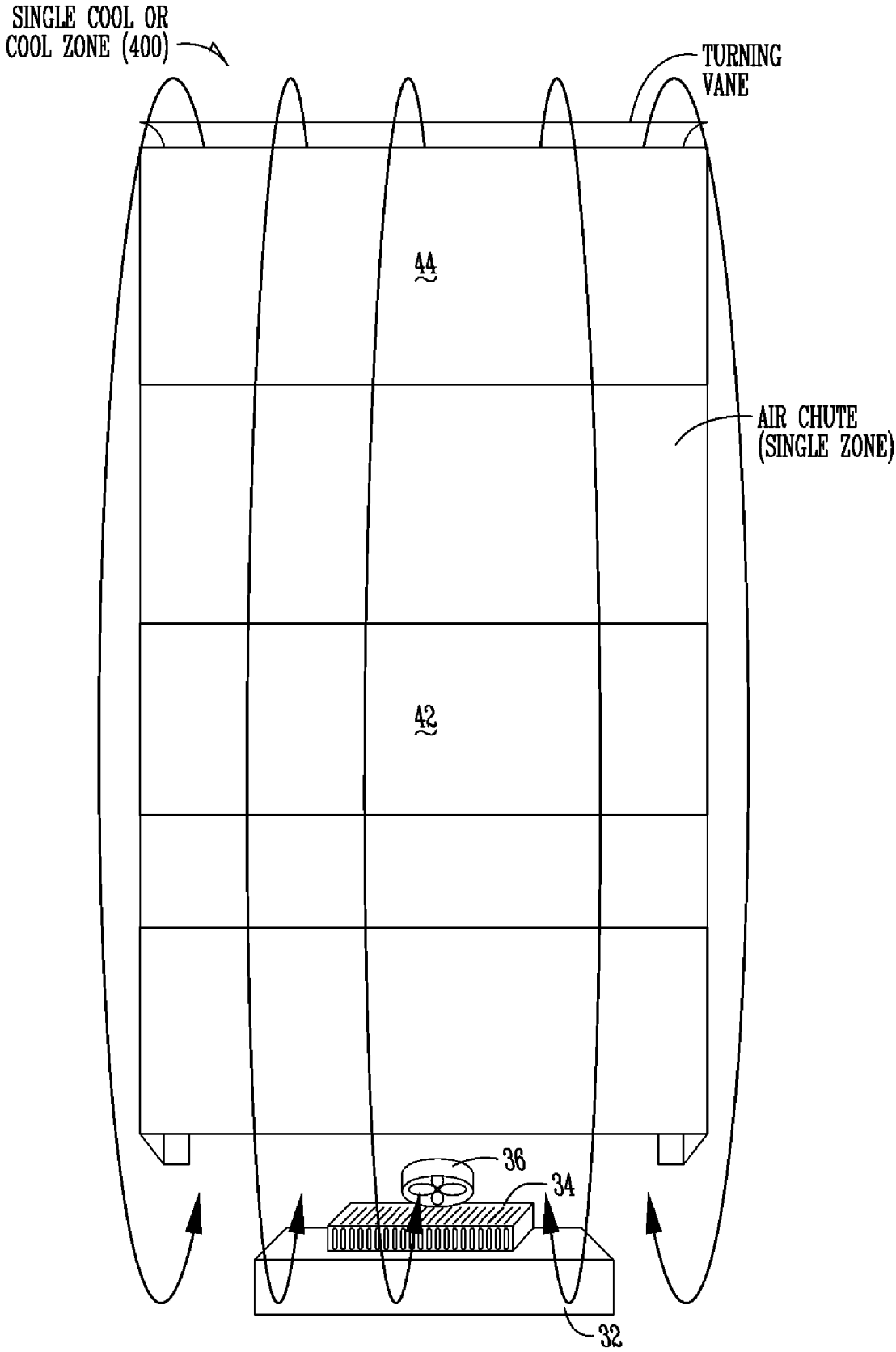
FIG. 4C is a perspective view of FIG. 4B but from a different angle.

FIGS. 4A-C illustrate how the base unit of FIGS. 3A-C can be configured for a single temperature zone embodiment for machine 10A.

1. Thermal Break in Liner

In the exemplary embodiments, the thermal break is always intact in the liner. This allows the machine to be configurable between embodiments. As indicated in the Figures, when the machine 10 is assembled, foam insulation can occupy gap 46 to further increase the ability to resist conduction of heat.

2. Eliminate Gap in Air Duct

Gap 46 in air duct 42/44 can be closed to create an uninterrupted air duct from an evaporator 34 to the top of the interior of machine 10A to take the coldest air and move it by fan 36 to the top. As illustrated in FIGS. 4A-C, the coldest air (see arrow 410) would be moved by fan 36, first, into uninterrupted duct 42/44. It would outlet at the top interior of machine 10A at 412. It would move forward and down (414 and 416) and fall over, around and through the trays 30A-30F (418, 422, 424), and move back through evaporator 34 (420) and be cooled and recirculated up through duct 42/44 again. The entire interior 400 is a single temperature zone. By methods and components well known in the art, temperature can be set and maintained at any point or range (e.g. from minus 15° F. to 70° F.) according to what level of temperature is desired in single zone 400.

A turning vane can be placed at the top open end of the air chute to turn air forward and across the top of machine 10, providing a curtain of laminar flow for limiting heat transfer through the top surface of the liner.

By appropriate thermal insulation techniques and selection of the refrigeration unit components and fan 36, as well as other conventional commercially available control circuitry, the temperature can be thermostatically set and generally maintain a set temperature or range in single zone 400 of embodiment 10A.

As illustrated in FIG. 4B, the single zone embodiment 400 basically eliminates the thermal break 48 and gap 46 in duct 42/44 by either separate pieces or by original manufacturing of those pieces without the breaks. This can be easily accomplished in the manufacturing and assembly process as these components can be sheet material that can be installed by appropriate methods or fasteners, or formed originally as desired. The remaining components of the machine are universal. No substantial modification needs to be made to the cabinet, refrigeration unit or the dispensing mechanisms, or the manner in which they are manufactured, mounted and operated within the machine. One exception is the air slots in the trays (see FIG. 10E-F). Note how all dispensers 30A-F are in single temperature zone 400, the liner is basically unitary with no thermal breaks, and the duct presents an uninterrupted air path from bottom to top of the interior of machine 10A.

FIG. 4C essentially shows the theory of operation for one zone machine 10A. The refrigeration unit 32/34/36 sends the coldest air at evaporator 34 up an uninterrupted vertical duct 42/44 to the top of zone 400. Fan 36 creates circulation of the air so that it first shoots up to and across the top interior and then is directed down to where it is drawn by fan 36 back through evaporator 34, where it is cooled and then reinserted into uninterrupted duct 42/44 back to the top of zone 400, and so on.

E. Base Unit Modified to Two Temperature Zone Configuration—FIGS. 5A-C

Figure 5A:
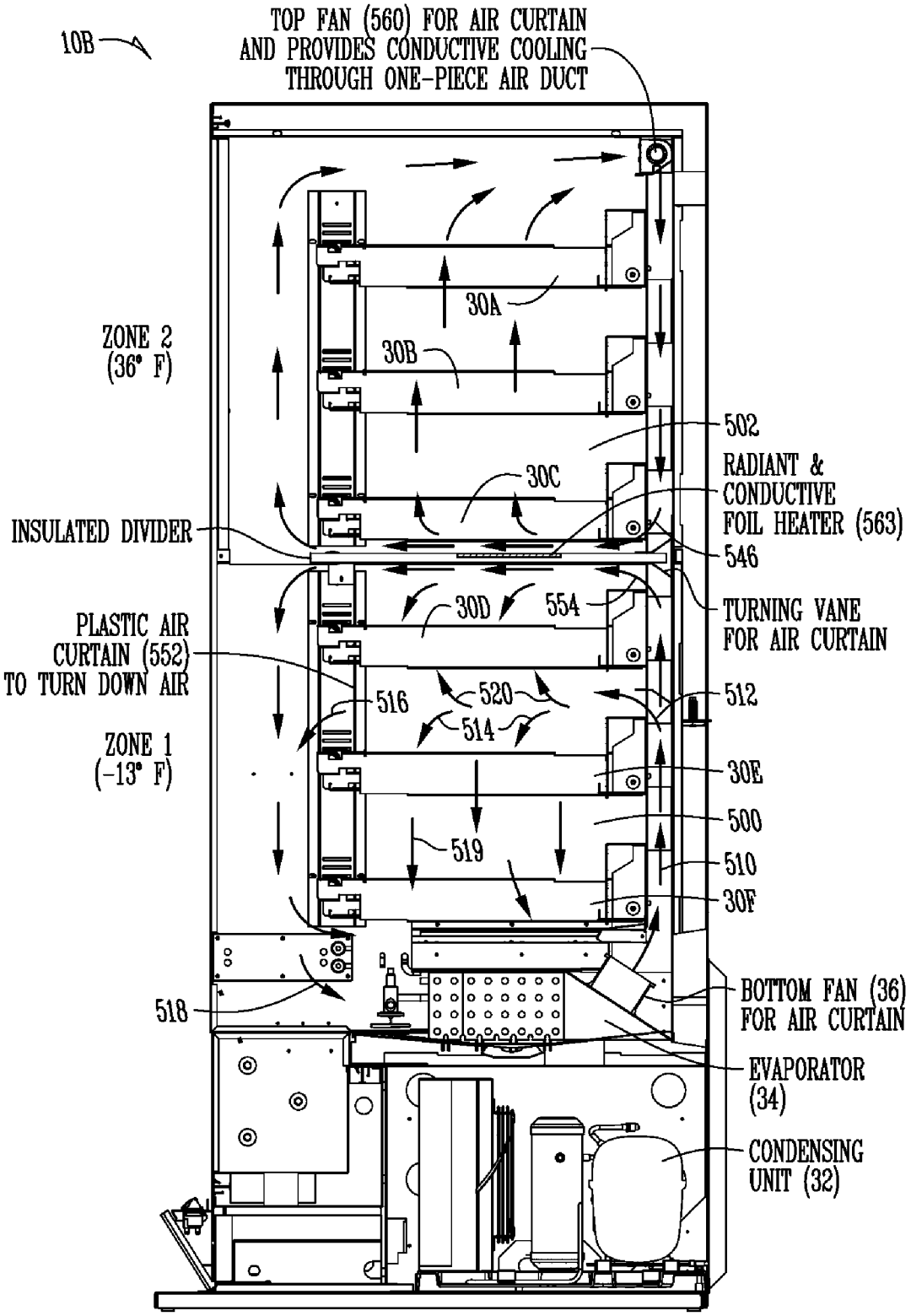
FIG. 5A is similar to FIG. 4A except it shows an assembled machine with two temperature zones.
Figure 5B:
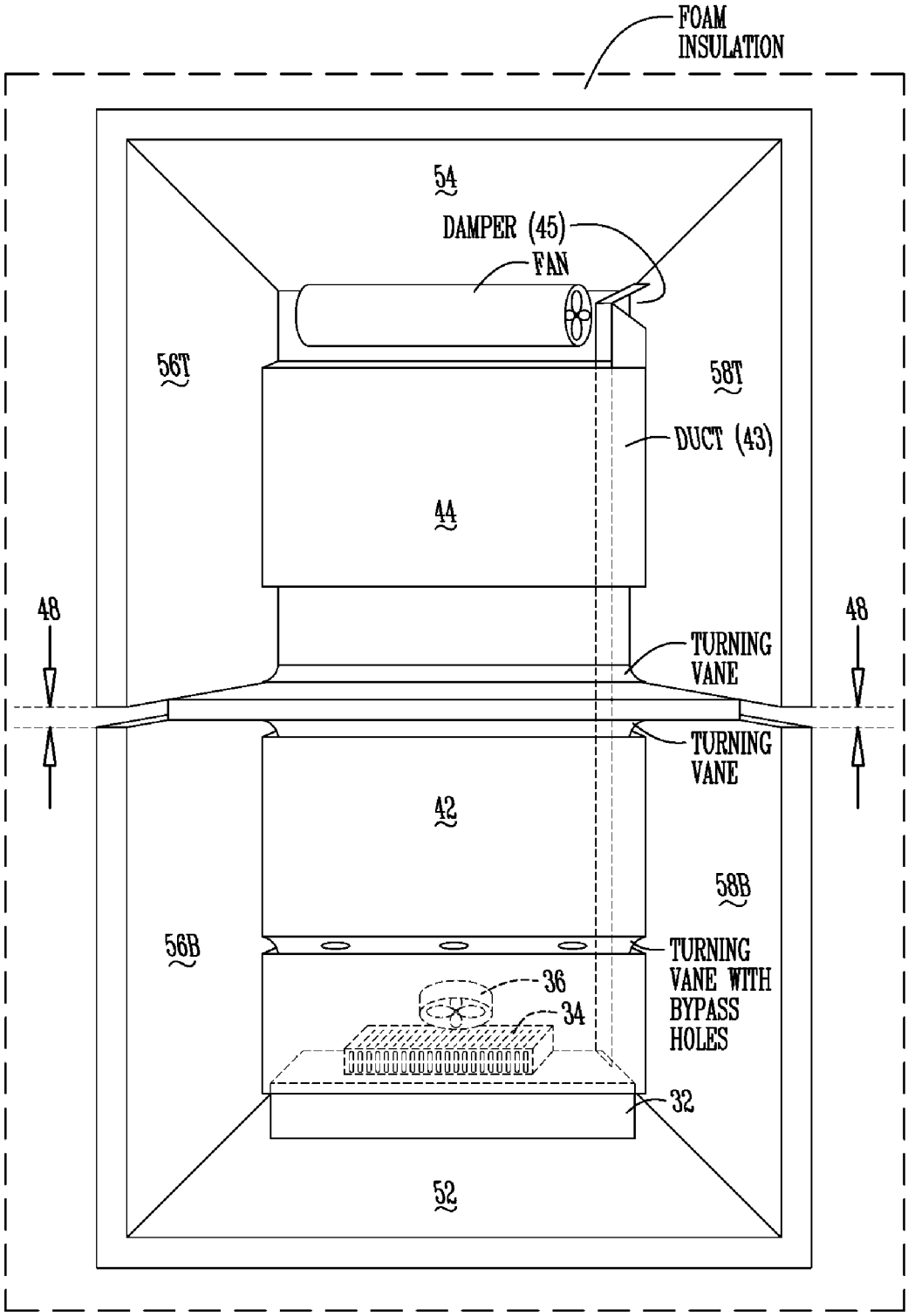
FIG. 5B is similar to FIG. 4B but shows diagrammatically how the basic interior of FIG. 3B is modified to create two zone refrigeration.
Figure 5C:
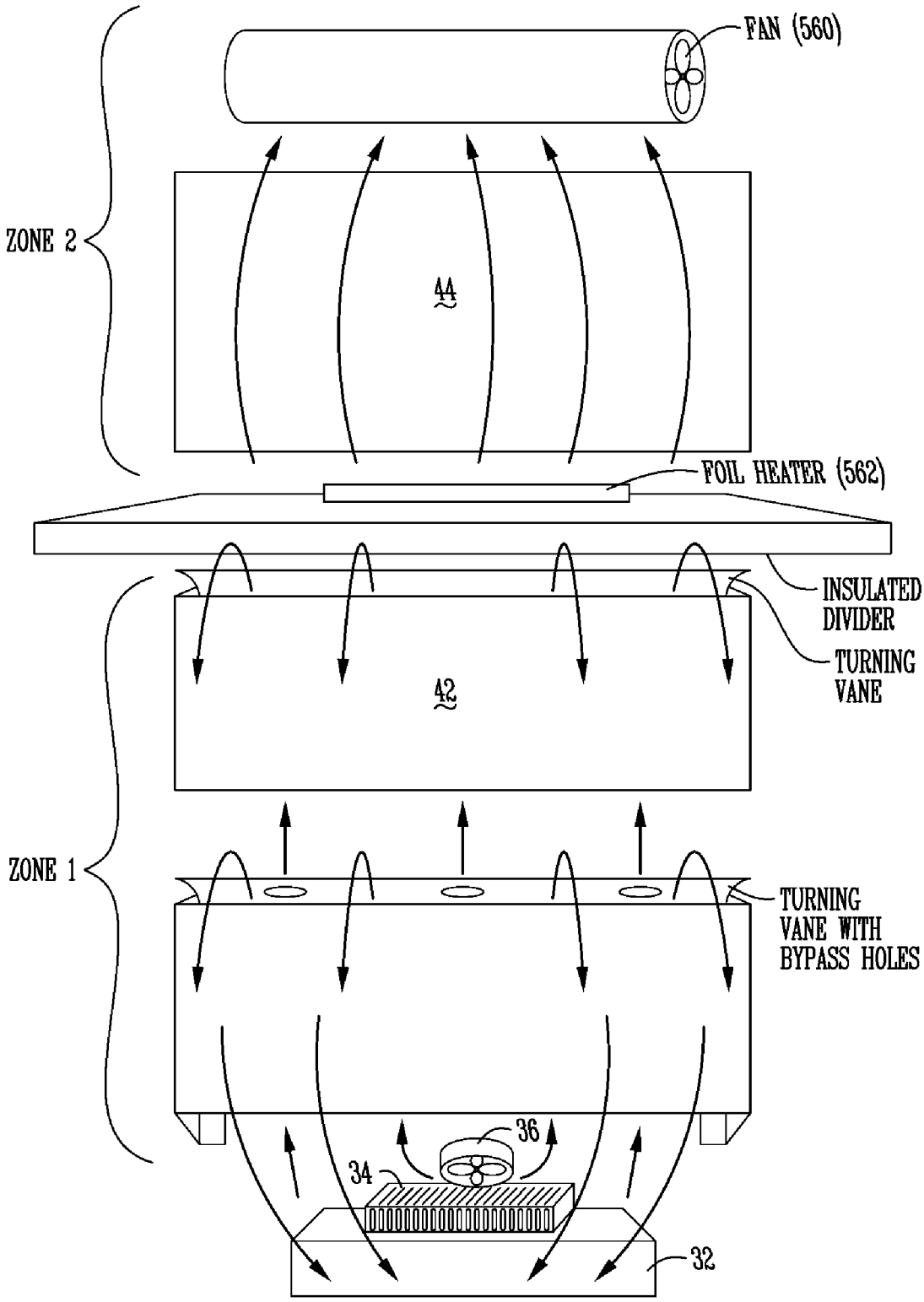
FIG. 5C is similar to FIG. 5B but from a different perspective.

FIGS. 5A-C show a two temperature zone embodiment 10B. As illustrated, the two zone refrigerated vending machine 10B is easily created from the base unit of FIGS. 3A-C as follows.

1. Thermal Break Is Utilized

Gap 48 is utilized. Gap 48 deters thermal conduction from what will be a warmer upper or top chamber 502 down to colder (frozen food) chamber 500. Thermal conduction may still occur in a limited amount by conduction through the joint between ducts 42 and 44, as well as limited transfer of air from the drop zone to top chamber 502.

2. Thermal Divider Separates Lower Zone from Upper and Blocks Duct

Additionally an insulated divider 551 is placed to occupy a substantial horizontal cross section of the interior of machine 10B (but not all of the cross section) (see FIG. 10I). Divider 551 extends through gap 46 of duct 42/44 and blocks or interrupts the pathway between its bottom and top ends.

Figure 7:
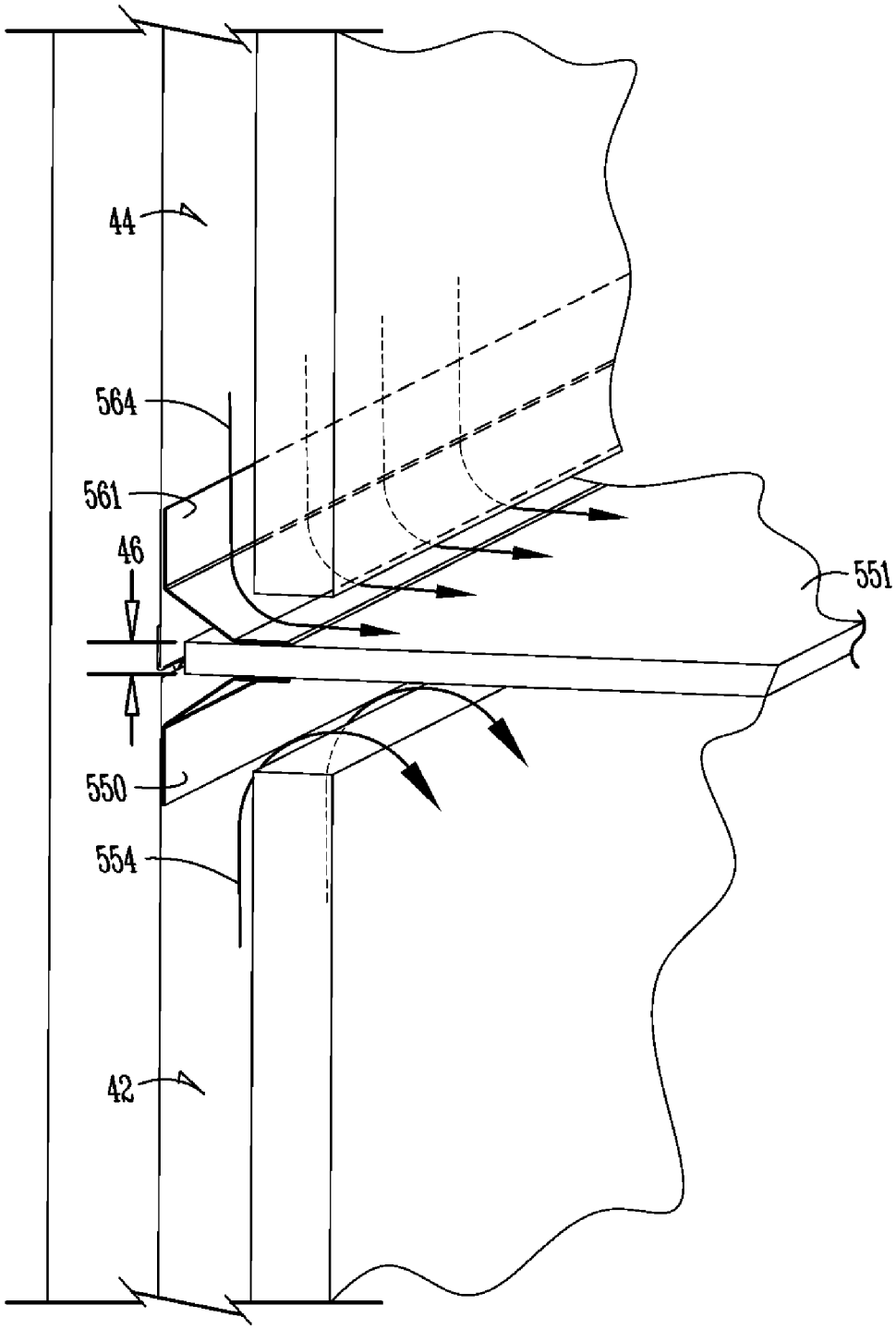
FIG. 7 is an enlarged partial perspective view showing in more detail air turning vanes that can be selectively positioned into the air duct.
Figure 8A:
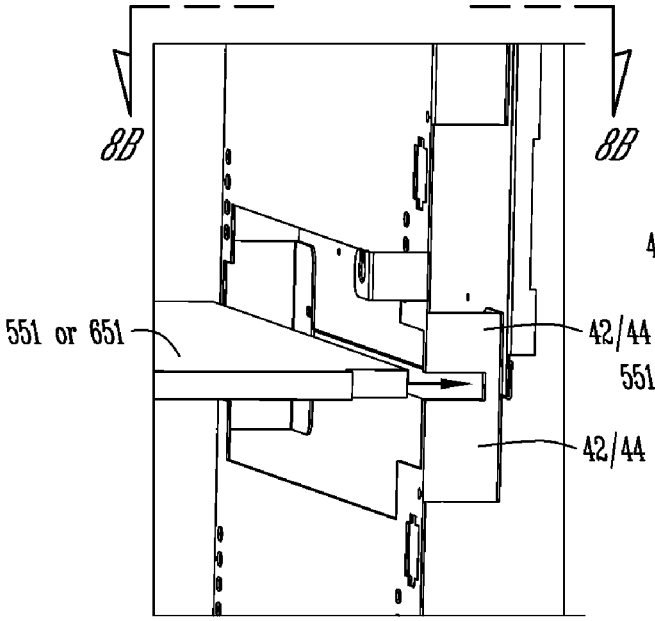
Figure 8B:
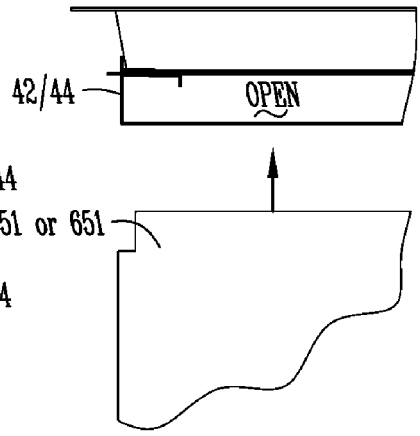
Figure 8C:
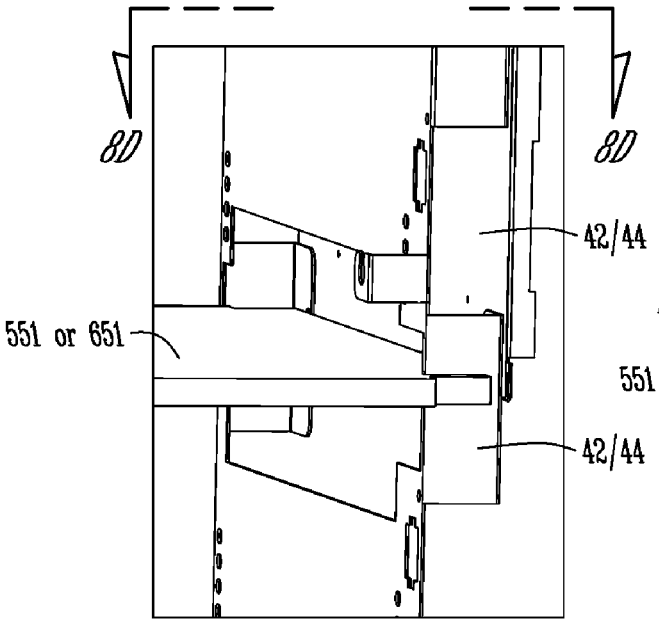
Figure 8D:
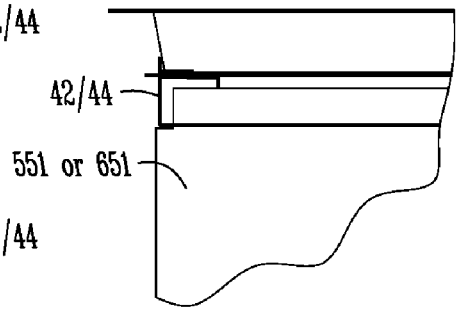

FIGS. 7 and 8A-D illustrate diagrammatically how divider 551 would function. It not only would extend across a substantial portion of the horizontal cross section of the interior of machine 10, it extends into and across gap 46 between duct portions 42 and 44. FIGS. 8A and B illustrate duct portions 42 and 44 and gap 46 before diverter 551 is installed. An uninterrupted air path is available vertically through portions 42 and 44. FIGS. 8C and D illustrate divider 551 installed in gap 46. It can completely block the air pathway (FIG. 8D). Thus, this partitions the air duct for multi-zone temperatures. In the case of divider 551, gap 46 between air duct sections 42 and 44 is ready-made for insertion of divider 551. Divider 551 can be made of any of a number of thermally insulating materials. The thermally insulating materials could form the divider. An example would be ½ inch thick EPS foam. Alternatively, a substrate or support panel could be used with a less rigid or robust insulation layer. As is well-known, heat tries to move to areas of lower temperature. Divider 551 would be selected to be of sufficient insulating or thermal barrier characteristics that it deters substantial movement of heat from upper cold zone 502 to lower frozen zone 500. However, it is advantageous if divider 551 is relatively thin (e.g. < or =1.2 inch thick) and light weight (1.8 lb/ft$^3$), but relatively rigid and robust.

The divider can be supported at the back by the two turning vanes and at the front by a bracket that attaches to sides of the liner.

3. Lower Turning Vane with by-Pass Air Holes

As illustrated in FIG. 5A, a turning vane 550 is inserted inside lower duct 42 at or around its indicated position to turn air 510 coming up duct 42 out a side opening into lower chamber 500. This "coldest air" from at or near evaporator 34 can be, e.g., at or near minus 13° F. (to maintain the temperature of frozen food). Vane 550 directs this "coldest" air 512 laterally from back to front as well as down (see arrows 516, 514) in the frozen food chamber 500. It is then drawn by fan 36 back through evaporator 34 (arrows 518, 519) and recirculated through section 44 of the duct and directed by vane 550 back into chamber or zone 500 to maintain a thermostatically controlled frozen food temperature in zone 500.

This lower turning vane has 0.25 inch diameter air by pass holes spaced along it to allow a controlled amount of cold air to pass through and continue up the air chute until it is turned forward and across machine 10 by another turning vane (without bypass holes) just underneath the divider. Note also in FIG. 5A (see also FIG. 10K) how a relatively small clear plastic sheet is hung down from the bottom of the third-from-the-bottom dispensing tray and towards the front of machine 10. This curtain functions like a turning vane to turn air moving across the bottom of the tray from which is hangs down to help it circulate down to the evaporator for cooling and recirculation. Also the dispensing trays can have holes or slots for air flow to disperse more evenly over the products.

As illustrated in FIGS. 5A-C, insulated divider 551 does not extend completely across the horizontal cross section of the interior of machine 10B. As best seen in FIG. 5B, a gap exists between at least one edge of divider 551 and the liner. The liner helps direct much of the "coldest" air coming into chamber 500 by vane 550 laterally across chamber 550, where it can be drawn down and through evaporator 34 by fan 36.

Note that turning vanes 550, 561 and 562 are shown diagrammatically in FIGS. 5B and C. They are adjustable relative their mounting by the elongated slots. FIG. 10H shows an actual example of how a turning vane could be formed. It could simply be a piece of sheet material that could be inserted inside air duct 42/44 at an opening (554 or 564) could be formed along the vertical wall of duct 42/44. As illustrated, the internal turning vane 550 or 561 could be mounted by appropriate means (screws, bolts, welding, adhesives) to direct moving air in the duct out the corresponding opening in the desired direction. This involves relatively easy and inexpensive modification of the air duct. FIG. 10H shows the optional additional air by pass holes used just for the lower turning vane. Note also how the shape of the turning vanes allows them to be used to support a divider.

Turning vane 551 could be made of sheet metal or plastic sheet or other materials that function to turn or divert the flow of air. Turning vanes are commonly used in HVAC sheet metal ducting to reduce pressure drops and smooth out air flow around corners in the ducting (especially square corners) (see, for example, turning vanes by DuctMate Industries, Charleroi, Pa. USA). They can be curved sheet metal that can be riveted, screwed, bolted, welded, or otherwise mounted inside an air duct. They can also take other forms (e.g. multiple generally parallel pieces or louvers at an angle to incoming air flow). Turning vane 551 is formed generally as shown in FIG. 7. An example of its size and curvature is 16" by 3" with 1" radius. It can be placed inside and across the air duct to direct moving air out a corresponding open along the side of the air duct.

A feature of the lower turning vane are air by-pass holes (see FIG. 10H). This allows a percentage of air to pass upward. The turning vane redirects the other percentage in its zone.

4. Air Curtain

The turning vane 551 controls air flow into each of the zones from the air duct 42/44. The turning vane directs air flow across the insulated divider 551. The air flow speed and temperature are controlled so as to promote or ensure laminar flow (and deter turbulent flow) across the insulated divider 551. This flow pattern reduces thermal conductivity between the insulated divider 551 and the cooled air. By promoting laminar flow over the insulated divider 551, the air forms an insulated barrier, further increasing the effectiveness of the thermal break between the zones.

The air flow required to maintain this air curtain may be established at manufacture either empirically or calculated by one skilled in the art, or may be dynamically controlled by the control board with programming by one skilled in the art.

5. Plastic Curtain

Note how a plastic air curtain 552 can be hung down from the bottom of the top-most tray in the bottom zone (See FIGS. 5A and 10K). Cold air would strike curtain 552 and some would be directed down in frozen section 500. Other air (532) would be directed up into chamber 502. An example of material for curtain 552 is clear PVC. It would be attached by appropriate fasteners or means and hang down generally perpendicular to and across from the air coming out of opening 554 associated with turning vane 550. Its dimensions can be selected based on the following types of considerations: width of tray space and depth of air stream. It is lightweight and its size can be adjusted as needed. In this example curtain 552 is approximately 1.5" by 18" by 0.012". The plastic curtain 552 further serves to limit transfer of cooled air from the drop zone to the top zone 502.

6. Heater and Second Fan

Upper chamber 502 is maintained around 36° F. for cold food products. A second fan 560 (e.g. Model JE-030A from JYS Enterprises) is installed at the top of duct 42. Additionally, a radiant and conductive heat foil heater 562 is operatively installed on the top side of insulated divider 551. By appropriate control, foil heater 562 can be, if needed, operated to create heat that is radiated upwardly in and throughout chamber or zone 502. A commercially available example of heater 562 is a two-ply foil construction foil heater from Springfield Wire, Inc. of Springfield, Mass. (USA). The heater is relatively low wattage.

Foil heaters are usually resistive heaters, using one or more thin, flexible resistive heating element(s) (e.g. wire) laminated between layers (e.g. aluminum foil). They can have the following characteristics: (a) relatively precise in placement of heat (specifically profiled heat patterns can be generated with higher watt densities in areas where heat loss is greater); (b) reliable and long life, (c) fast warm-up, (d) large surface area; (e) self contained, one piece, (f) wide range of sizes, (e) available with own thermostat. They can be mechanically fastened or adhered to a mounting surface. They have standard terminations. Typical applications include battery warmers, cabinets, defrost applications, heated food tables, laboratory equipment, incubators, and ceiling and wall panels.

Foil heater 562 is preferably a two-ply foil heater. Preferably PVC or silicone heater wire is bonded between two pieces of foil, giving a slightly higher profile. This allows wattages of up to 120 watts. Heater 562 is approximately 16" by 12" by 0.005" and operates at 120 watts.

Fan 560 draws air from the top and blows it across foil heater 562 to warm the zone to the set point. Fan 560 would push air down into the top of duct portion 44 (see arrow 528). Another turning vane 561 and opening 564 at the bottom of duct portion 44 would reintroduce air into zone 502 right above insulated divider 551 and pass it over foil heater 562. In this manner, air in the top of machine 10B (cold food section 502) would be circulated but would be maintained thermostatically at the higher temperature than the air in frozen food section 500.

FIG. 5B illustrates the principles of the two chamber or two zone machine 10B. FIG. 5C does likewise. Note how dispensers 30A-C are in the top or cold food zone 502, and dispensers 30D-F are in the bottom or frozen food zone 500.

Note also that any of the models for machine 10 could include a heat reflective cover over at least a portion of the evaporator to reflect heat up and away.

The foil heater 562 further aids in maintaining controlled air flow throughout the zones. Buoyancy principles require that warm air rises while cold air falls.

In the frozen zone, cold air is forced out near the top of the zone. The cold air then falls to the bottom of the zone where it is drawn into the evaporator. This setup ensures that cold air is continually refreshed in the frozen zone. As previously described, (a) use of an air duct across the entire body of the housing, (b) an outlet across the width of the air duct, (c) turning vanes, (d) plastic curtains (if needed), (e) and controlled air flow, promotes controlled laminar air flow through each zone.

In the cooled zone, air is forced out the bottom of the zone. The air then flows across a heater where it is warmed. This warming causes the air to rise to the top of the zone. The warm air is then drawn into the duct by the fan. By controlling the heating element and fan, the cooled zone may be maintained at a set temperature.

The buoyancy principle is utilized in this invention in order to maintain separate and distinct temperature zones in the vending machine. This principle, coupled with the turning vanes and/or air curtains, allows for great differences in temperature between the two zones. Also, the thermal break, insulating zone divider, and/or other techniques and components cooperatively promote the same. This principle is commonly known in the art as stratification, where separate zones have separate properties, such as temperature, and remain segregated. This eliminates the potential for the system to tend towards equilibrium, where the thermal difference between the two zones becomes negligible. Minor air flow may occur between the two zones, but generally the plurality of zones maintain distinct air pockets.

F. Two Zone Configuration Modified to Three Zone Configuration—FIGS. 6A-C

Figure 6A:
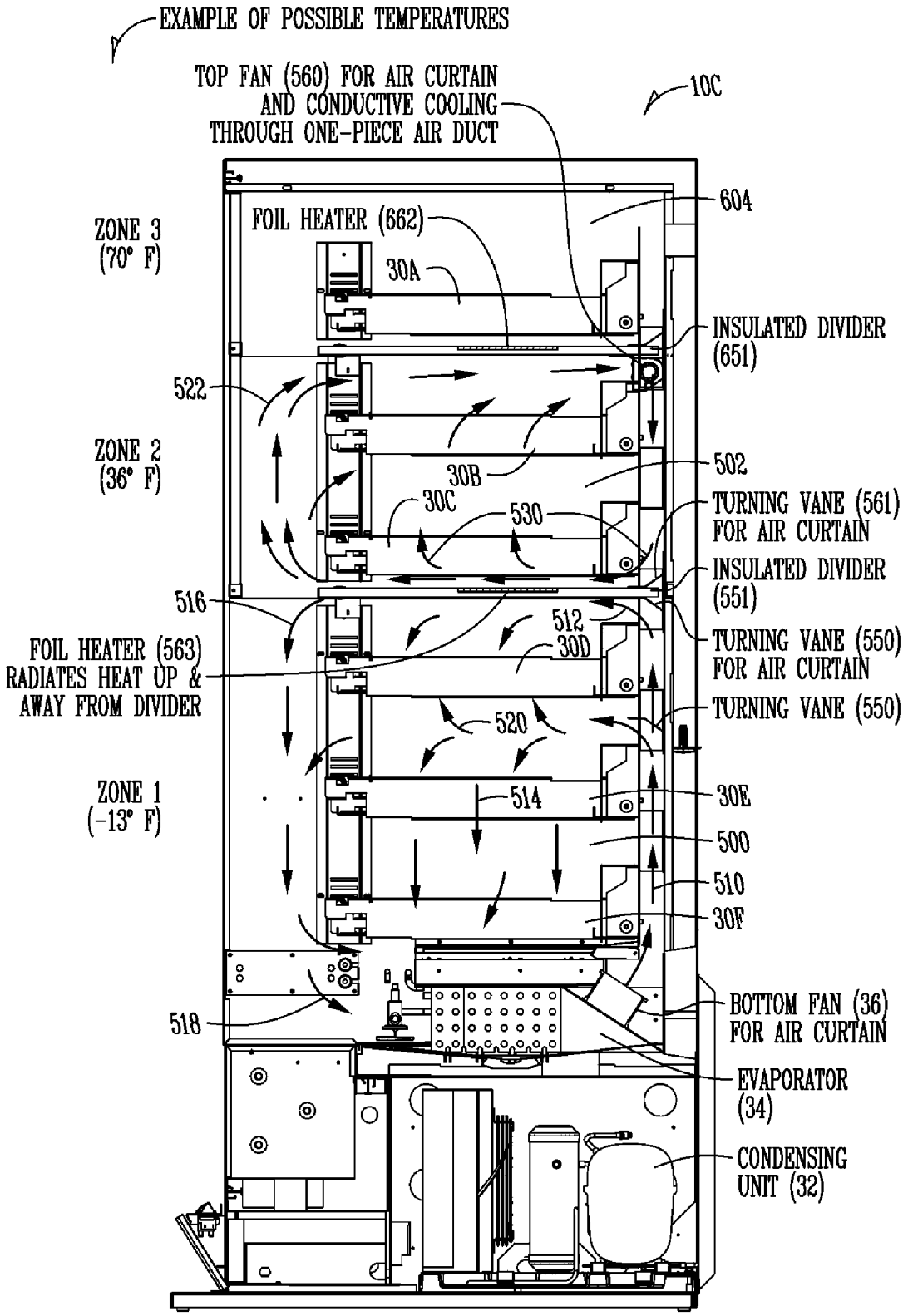
FIG. 6A is similar to FIG. 5A except it shows an assembled three temperature zone machine according to a further embodiment of the invention.
Figure 6B:
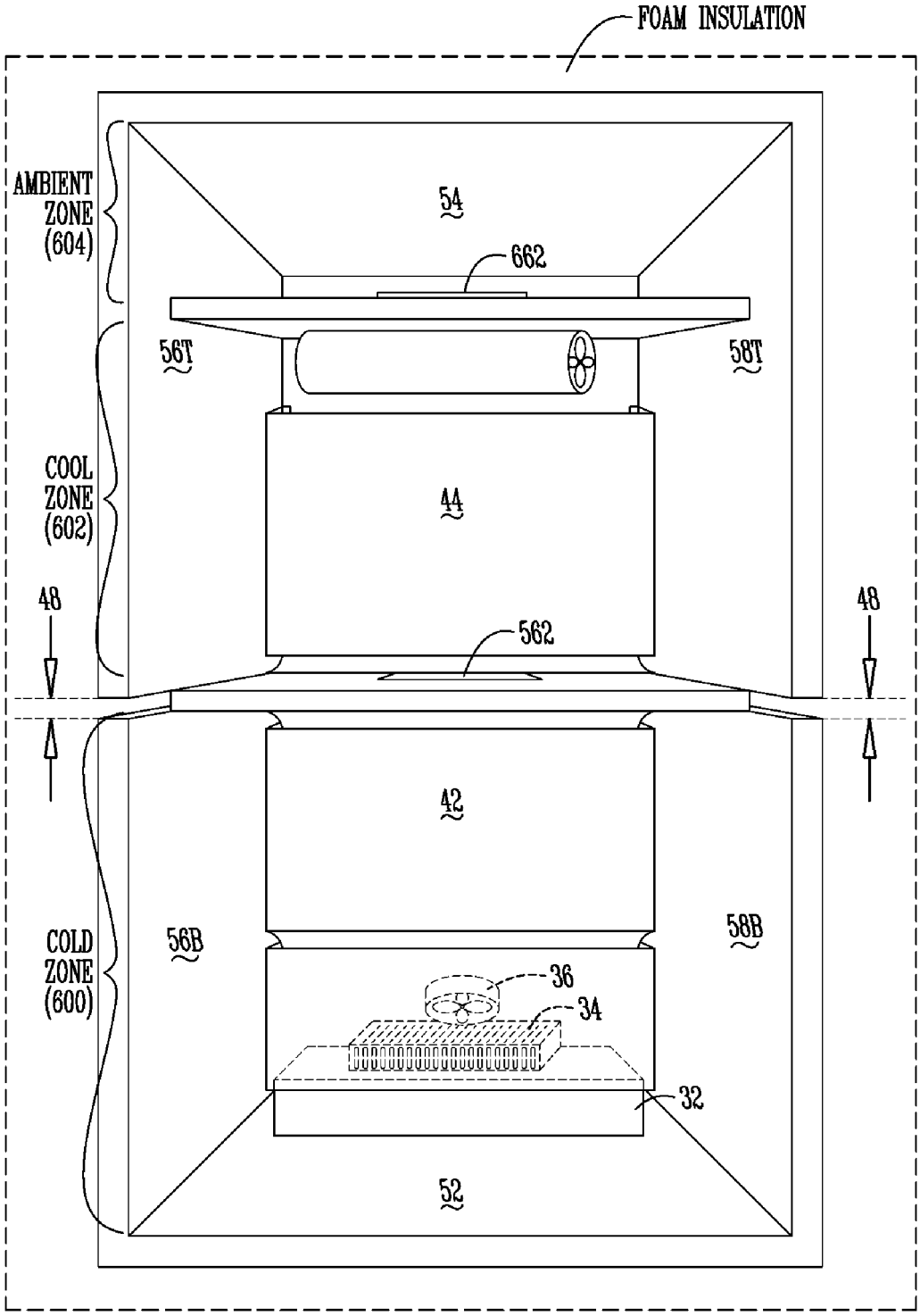
FIG. 6B is a diagram of the three zone machine of FIG. 6A.
Figure 6C:
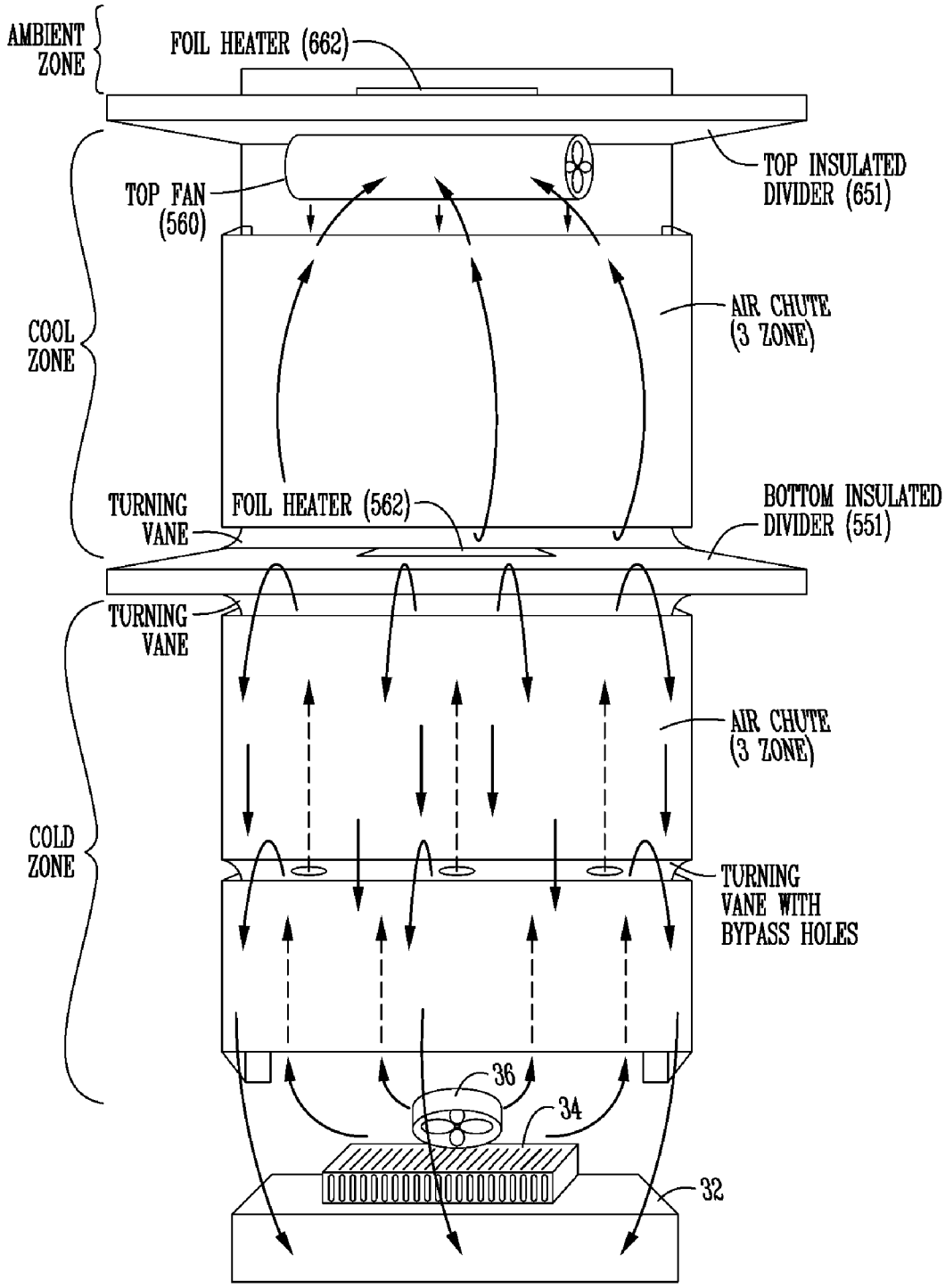
FIG. 6C is an alternative diagrammatic depiction of the three temperature zone embodiment.

FIGS. 6A-C illustrate three temperature zones can be easily configured starting with the same base component of FIGS. 3A-C. Three zone machine 10C essentially uses the two zone principles of FIGS. 5A-C with the following differences.

1. Second Thermal Divider

A second divider 651 (similar to divider 561) of thermal insulating properties extends over a substantial horizontal cross section of machine 10C near the top of its interior space. A second gap along duct 42/44 could be created and receive divider 651 in a manner like divider 551 in gap 48. Divider 651 could be mounted in other ways.

2. Second Heater

A second foil heater 662 (similar to heater 562) is placed on the top side of second divider 651. Divider 651 blocks air duct 44 at the location indicated. Top fan 560 can be moved just below the second divider 651.

As illustrated in FIG. 6A, insulated divider 551, turning vane 550, and plastic air curtain 552 cooperate, as previously described with respect to FIGS. 5A-C, to direct coldest air (e.g. minus 13° F.) into and circulated around lower frozen food temperature zone 500.

Also, like the embodiment of FIGS. 5A-C, some of that coldest air is allowed to pass around the side of insulated divider 651 up into a cold food temperature zone 502 (see arrow 530). Fan 560 and turning vane 561 cooperate with appropriate openings along the side and adjacent to those components to circulate cold air (36° F.) within cold food section 502. Foil heater 562 is operated to provide heat, if needed, to maintain that higher temperature.

Second insulative divider 671 is installed as indicated in FIG. 6A. Second divider 671 blocks off most of the upper ambient temperature zone 604 from the air circulating in zone 502, and a second foil heater 662 is appropriately controlled to maintain the temperature at around 70° F. in top zone 604.

FIGS. 6B and C further illustrate those principles. Note that dispenser 30A is in the ambient (non-refrigerated section) zone 604 at the top of machine 10C, dispensers 30B and C are in the middle cold zone 502, and dispensers 30D-F are in the bottom freeze zone 500. As can be appreciated by reference to this description and the Figures, the size of each zone can be varied from those shown by simply shifting positions of the components.

As can be seen, by appropriate selection of just a few components and/or modifications, machine 10 can be assembled and operated as either a one zone temperature refrigerated vending machine or a two or even three zone machine.

FIG. 6C shows an alternative view of the three zone configuration and provides additional operating information.

G. Selection and Assembly of Mode of the Machine

As can be appreciated from the foregoing description and drawings, a benefit of the design of machine 10 is that it can be efficiently and economically constructed into any of the one, two, or three temperature zone modes. The base unit of FIGS. 3A-C can be mass produced. Thus, a substantial majority of the components for a fully assembly machine 10 are the same for each machine 10. This includes major cost components such as the condenser, evaporator, main fan 36, cabinet, dispensers 30, and electronics and electrical circuits and equipment.

An inventory of parts needed for any of the one, two, or three zone models can be created and made readily available to the assembly workers. Once selection of mode (one, two, or three zone machine 10A, 10B, or 10C), the base unit is modified accordingly by pulling the relevant parts from inventory.

The machine is reconfigurable. FIGS. 10A-N illustrate individual components of the machine, allowing it to be easily configured into one of the various possible embodiments.

FIG. 10A illustrates a starting metal outer shell for the machine with an inner liner with thermal break. Note the bottom space for the refrigeration unit.

FIG. 10B illustrates the liner in isolation. It is to be understood that the metal shell and liner combination of FIG. 10A can be formed as follows. The liner of FIG. 10B can be pieced together at the factory according to which embodiment is desired. Using well-known methods, the liner can be placed in the sheet metal shell of the vending machine and placed in a machine or jig to hold them in position with a gap between them (as indicated in FIG. 10A). Foam insulation can be blown between the shell and the liner, including filling in any thermal break in the liner.

FIG. 10C illustrates the air chute piece that with the back wall of the liner created the vertical air chute for each model of machine 10. Note also that this air chute piece includes holes and slots to help support adjustably the dispensers' trays and motors.

FIG. 10D is illustrates in isolation a plurality of trays that could be placed in the machine, and FIGS. 10E and F show a single tray in detail, including the added air holes or slots.

Figure 12D:
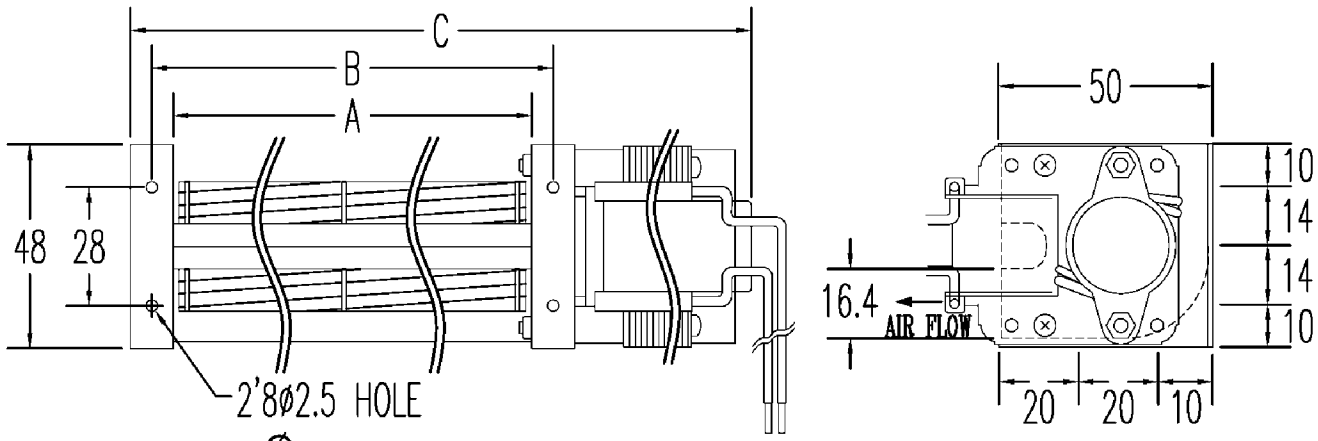
Figure 12D:
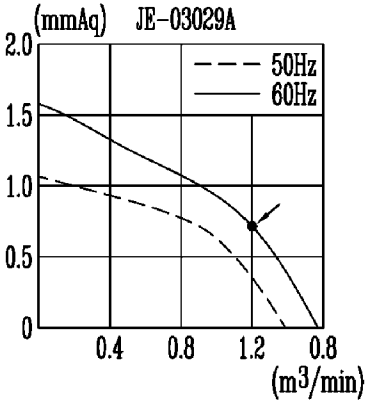
Figure 12E:
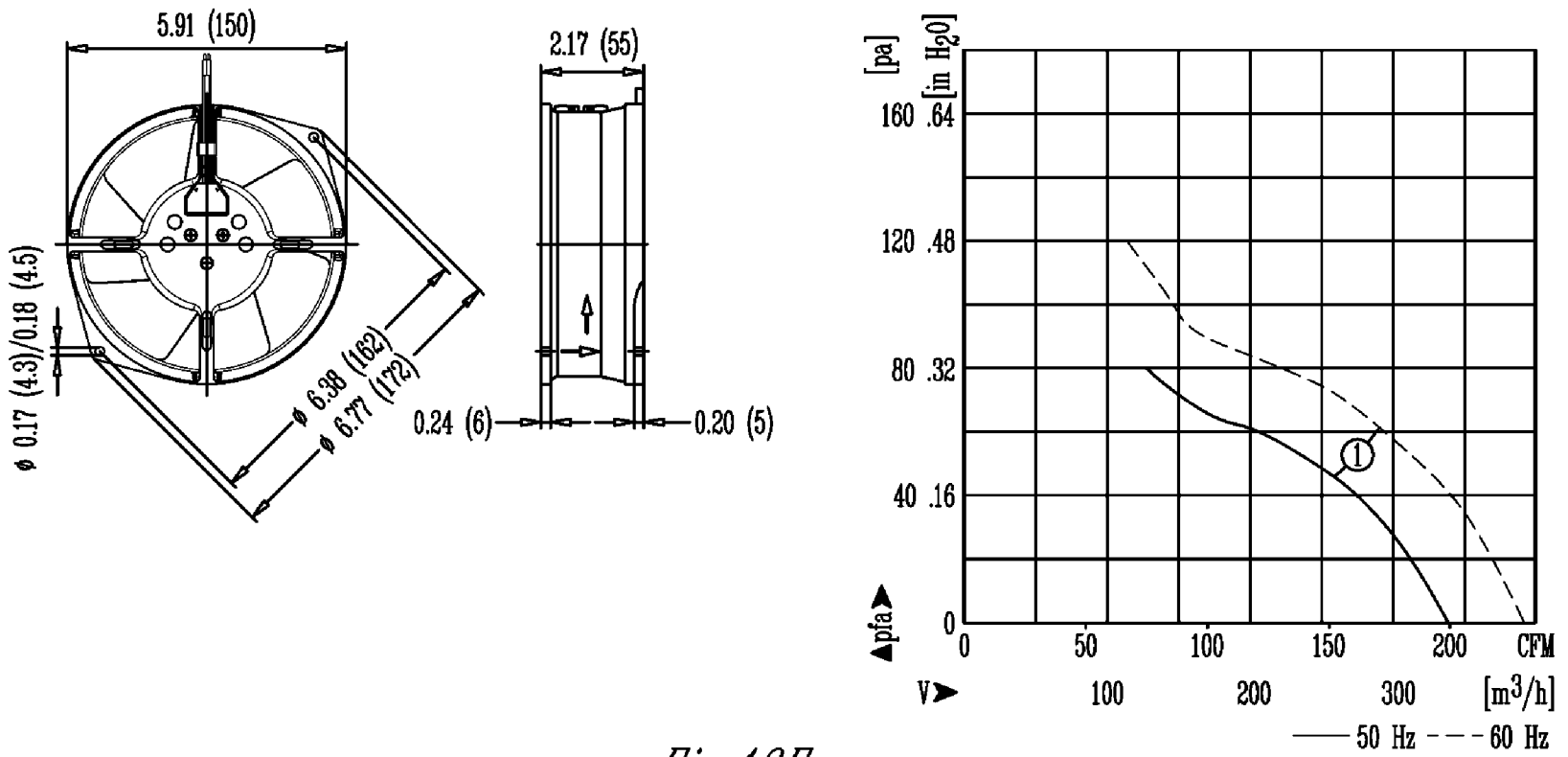

FIG. 10G illustrates in enlarged fashion a top fan such as can be used. FIG. 12D gives details about such a fan as could be selected for use with machine 10.

FIG. 10H illustrates various views of the lower-most turning vane with air holes. The other turning vanes can be the same or similar without the air holes.

FIG. 10I illustrates in enlarged view the rigid insulating divider.

FIG. 10J illustrates, in section view, how divider can be mounted in machine 10 between turning vanes, and the relative position of the turning vanes and top fan for the two zone model.

FIG. 10K is a sectional view of a two zone machine including showing air movement for the zones relative the air chute, the turning vanes and the evaporator and top fan.

FIG. 10L is a still further enlarged partial view of FIG. 10K showing the top fan, the divider, and its adjacent turning vanes in more detail.

FIG. 10M shows a sectional view from the back perspective of machine 10. It shows the back of the air chute member and the relative position of the top fan, the divider and its adjacent turning vanes, the lower turning vane with air holes, and the access to the fan/evaporator of the refrigeration unit. This is essentially looking at the air chute with the back wall of the liner removed.

FIG. 10N is a sectional view from the side of machine 10. Refer to FIG. 12A for specifications for an example of a condensing unit (Danfoss brand air cooled condensing unit model LCHC0050R60000B) that can be used with machine 10, FIG. 12B for an evaporator, new FIG. 12C for a foil heater, FIG. 12D for a top fan, and FIG. 12E for the bottom fan (the evaporator fan). The manufacturer and model number of the condensing unit have been added from FIG. 12A as a parenthetical.

The evaporator fan is preferably an AC fan with an external rotor shaded-pole motor, impedance protected against overloading. The housing is of die cast aluminum and the sheet-steel impeller is directly welded onto the rotor. The rotational direction is counterclockwise, and exhausts over the struts.

H. Operation and Control Circuitry

The foregoing described how the base interior of machine 10 can be efficiently and effectively assembled into one of three configurations at the factory to create a one, two, or three temperature zone automated merchandizing machine. As can be appreciated by those skilled in the art, appropriate control circuitry to carry out any those embodiments can be easily incorporated into machine 10.

The operation of the different embodiments had been described above. FIG. 9 illustrates diagrammatically an example of a control circuit that can be easily configured to operate any of the three embodiments.

Circuit (indicated generally by reference number 900) could include a controller 902 (or other programmable circuit) that would perform the following functions.

(1) Operation of refrigeration unit. Controller 902 could issue instructions to the control circuit 910 of the refrigeration components to operate them when removal of heat is called for. Such control is well known in the art.

(2) Operation of fans. Controller 902 could selectively issue instructions to run any of fans 36 or 560.

(3) Operation of heaters. Controller 902 could likewise selectively instruct operation of any of heaters 562 or 762.

(4) Thermostatic control. Controller 902 could receive temperature readings from temperature sensors 921, 922, and/or 923 and be programmed to use those readings to thermostatically control and maintain an appropriate temperature according to how machine 10 is configured. For example, for machine 10A (one zone), only one temperature sensor is needed. It could be programmed to trigger if a certain temperature is exceeded. The triggering of the sensor would be communicated to controller 902, which could be appropriately programmed to run the refrigeration system and fan 36 to bring the temperature back to within range. In the one zone configuration, it is possible to have a single upper temperature set point on the temperature sensor, as the main concern is to keep the whole interior of machine 10A below a certain temperature.

As can be appreciated, for two zone machine 10B, two temperature sensors could be used, one for zone 500 and one for zone 502. If either triggers at its set point, controller 902 would operator to run the refrigeration system and at least fan 36 to cool the corresponding zone back below set point. This may involve operation of second fan 560, or not, depending on which temp sensor triggers (or other pre-programmed parameters). Additionally, controller 902 could operate for selected time periods heater 562 as a part of maintenance of an appropriate temperature range in zone 502. The heater could be run automatically. Alternatively, for example, the temperature sensor in zone 502 could have two triggering set points, an upper set point if sensed temperature exceeds the upper limit for the zone, and a lower set point if sensed temperature drops below a lower temperature limit for the zone. Or further, there could be two temperature sensors in zone 502, one for the upper set point and the other for the lower set point. If temperature in zone 502 exceeds the upper set point, the refrigeration unit is operated to bring it back with range. If zone 500 or the air moving up from zone 500 is so cold that the temperature of zone 502 drops below the bottom set point, controller 902 would be triggered to operate heater 562 until temperature comes back up within range for zone 502.

Similarly, for three zone machine 10C, temperature sensor 923 and heater 672 could work to keep that upper zone 604 at or near a pre-programmed temperature or range (e.g. 70 degrees F.) This could be accomplished with one set point (i.e. operate the refrigeration unit only if temperature drops below a certain level). Or a two set point system could be used to try to keep both a lower and upper temperature limit in zone 604.

As can be appreciated, controller 902 could alternatively be more electro-mechanical than electronic. Conventional thermostats and switches or contactors could turn the refrigeration system, fans, and heaters on and off.

Still further, at least some functions of circuit 900 could be integrated into a conventional programmable vending machine controller, which is common in modern vending machines and controls the vending functions such as validation of tokens or money, instructing operation of the dispensers, providing change, etc.

FIG. 11A provides a detailed flow chart of operation of the machine. The flow chart provides specifics that one skilled in the art could follow to operate a model of machine 10. The following definitions apply to the flow chart. "Defrost Period" means the total period of time of a refrigeration cycle in between Defrost (8 hours). "Power ON Delay" means the time before the start of the main software program (10 Seconds). "OFF Time Delay" means the minimum compressor OFF time before the compressor can start again (3 Minutes). "Defrost Duration" means the time an operation occurs (30 Minutes Max).

Additionally, sensors and relays are abbreviated Sensor 1-3 and Relay 1-6. Sensor 1 represents the cabinet sensor, Sensor 2 the evaporator sensor, and Sensor 3 the second zone sensor. Relay 1 represents the compressor, Relay 2 the evaporator fan, Relay 3 the evaporator heater, Relay 4 the second zone heater, Relay 5 is TBD, and Relay 6 the light control (RFU).

FIG. 11B provides design considerations to assist a designer sizing components for a machine 10, e.g., to meet NAMA requirements.

FIG. 11 C is a control description of how a control circuitry would operate a machine 10. T1 represents the evaporator coil temperature sensor, T2 represents the cold zone temperature sensor, T3 represents the cool zone temperature sensor, and T4 represents the ambient zone temperature sensor. Various forms, F1-3, are also shown in FIG. 11C. F1 represents the condenser fan, F1 the evaporator fan, and F3 the cool zone fan. S1 and S2 represent the controller door switch and cool zone fan (F3) switches, respectively. H1-4 represent heaters within the machine. H1 is a 17 watt drain heater, H2 a 500 watt defrost heater, H3 a 120 watt foil heater, and H4 a 120 watt foil heater. B1 and B2 represent insulation barriers. Turning vanes TV 1-3 are also shown. C1 represents the compressor.

In multizone mode, T1 terminates defrost and controls fan F2. T2 controlls compressor C1 and health and safety. T3 controls heater 3 and health and safety. T4 controls heater H14. Further, fan F3 runs continuously when the door is closed, but is turned off when the door is open, as controlled by switch S2. Fan F2 is on when T1 registers less than 30° F. and C1 is on, and is off when the door is open and during defrost. Fan F1 is on when compressor C1 is on.

In a dual zone mode, B2, H4, and T4 are removed and T2 is moved to the top. F3 is not used in this mode.

In single zone, B1, B2, TV1, and TV3 are removed and TV2 is moved to the top. T2 is not used and T3 controls compressor C1 and health and safety. F3 is not used in this mode.

Machine 10 provide an efficient and economical way to create the different models of refrigerated vending machines. It is efficient and economical to manufacture as well as use. It is an economical balancing of the many factors discussed herein. It is flexible to be configurable or retroactively reconfigurable into single or multi-temperature zones and to meet required standards, such as the NAMA standards or government regulations.

It can therefore be seen that the exemplary embodiment addresses and meets one or more of the objects of the invention. It can be seen that the embodiments follow these principles:

Essence of the Multi-Zone

A. Vending machine with common open fall space
B. One evaporator and condensing unit
C. Configurable from single to several controlled temperature zones
D. Zones are thermally isolated by insulated barriers and breaks in the sheet metal liner and other conductive parts
E. Zones are stacked from bottom to top with coldest on bottom and warmest on top; taking advantage of buoyancy for stratification between zones F. Common sheet metal air duct between zones but separate air streams with separate circulating fans for each zone that transfers heat to air duct through convection and between zones through conduction G. The air circulating in each zone is controlled with turning vanes and deflectors to keep it from striking the front, creating turbulence and eddying into an another zone through the open fall space H. The bottom zone, the coldest, is a thermal reservoir that heat can be transferred to for cooling of the upper zones.

I. Heating elements are used in the upper zones to maintain temperature set points but the circulating fans could be cycled on and off or ramped up and down with a speed control to regulate heat transfer and maintain preset temperatures as well.

J. Heat transfer between zones, via conduction, must be designed/sized to recover after servicing or filling, within health and safety time limits for perishable foods (see FDA regulations).

As can be appreciated, individual features described herein can be beneficial. Also, combinations of features can likewise. For example, in one combination, the wide air duct across one side (the back) of the interior, the turning vanes, the added fan(s), the thermal breaks and insulated divider, the heater, cooperate to produce effective multiple temperature zones. Also, the multiple zones can be built-in to an originally manufactured machine or a machine could be retrofitted.

I. Options and Alternatives

As previously mentioned, the Figures illustrate a few forms the invention can take. Variations obvious to those skilled in the art will be included within the invention.

For example, the precise configuration of the air ducting, the refrigeration unit, methods of moving air, the methods of directing air, and the methods of configuring the components together can vary according to need or desire.

The size of machine 10 can vary. The Figures show one width. Wider or narrower, or shorter or taller machines can be configured according to the invention.

By further example, the control system for the invention can be adapted to utilize control components well known to those skilled in the art. Temperature sensors, for example, could be placed in each temperature zone. The temperature read by the sensor could be fed back to a control circuit which could, by varying the duty cycle of the refrigeration unit, the speed of a fan, or the amount of heat generated by a foil heater(s), maintain a temperature within an acceptable range. Such components are relatively non-complex and inexpensive.

An option would be a display that displays the current temperature of each zone. Such displays are commercially available and can be hooked up to the temperature sensors for each zone.

According to the exemplary embodiment, the vending machine 10 has a narrow width relative to the depth of the machine. The machine may be of a varying width, either greater or less than as shown.

In multi-zone refrigerated systems, such as the two zone machine 10B shown in FIGS. 5A-C, there may be a need to increase air flow to the cooled zone. For example, when the vending machine door is opened for service of maintenance (or a defrost cycle has occurred), the temperature of the cooled zone is increased towards ambient. An increased air flow to the cooled zone would allow the cooled zone to be swiftly cooled. One embodiment which would provide this increased air flow is generally shown in FIG. 5B (e.g. 1"×1" cross-section). Air duct 42/44 may be subdivided having a narrow duct 43 therein. This narrow duct 43 carries air directly from the evaporator 34 to the cooled zone. In the cooled zone at the duct outlet there is a damper 45. This damper 45 is controlled by the controller 902 to alternately open or close based on the temperature in the cooled zone or other input, such as opening the vending machine door. The narrow duct may further include a fan to force cooled air into the cooled zone from the evaporator. A thermistor or thermostat could automatically actuate the damper. Or a door activated switch would open the damper if the front door is opened.

Preferably the duct is approximately 1-2 inches square although other sizes or shapes are contemplated. The damper is also preferably a two-state damper, open or closed, although variable states of opening are contemplated.

The two- or three-zone configuration preferably has a frozen zone in the bottom most zone and a cooled zone positioned above the frozen zone. It is anticipated that the invention could be utilized to provide a cooled, non-frozen zone (for example, between 35 and 40° F.) in the bottom most zone and a cool, non-frozen zone (for example, between 50 and 60° F.) positioned above the cooled zone. According to this alternative, the upper zone would remain at a higher temperature than the lower zone.

Additionally, the two- or three-zone configuration may be designed so that the lowest-temperature zone is not positioned in the bottom of the vending machine. For example, the cooling unit may be positioned above the thermal break, allowing for a frozen zone above a cooled or ambient zone.

What is claimed is:

1. A refrigerated vending machine having a cabinet defining an interior space, at least one vendible product dispenser, and a refrigerator unit including an evaporator, and a control circuit, the machine being adaptable for selective configuration between a single or multiple temperature zone machine, comprising:

a. a liner adapted for placement in the interior space to define a product bay, the liner being configurable between;

i. a first mode corresponding to a single temperature zone; and ii. a second mode comprising a thermal break in the liner between sections of the liner corresponding to adjacent multiple zones;

b. an air duct having a first end at the evaporator and a second end at a spaced apart location in the product bay defining an air path axis, the liner and air being configurable between;

i. a first mode corresponding to a single temperature zone;

ii. and a second mode comprising at least one outlet from the air duct for each of multiple temperature zones.

2. The machine of claim 1 further comprising a divider positioned between adjacent temperature zones.

3. The machine of claim 2 wherein the divider is thermally insulated.

4. The machine of claim 2 wherein the divider includes a portion that blocks the air path along the air path axis.

5. The machine of claim 2 further comprising a turning vane in the air duct at the outlet from the air duct for at least one temperature zone.

6. The Machine of claim 2 further comprising a member positioned spaced from the outlet to direct air from the outlet.

7. The machine of claim 6 wherein the member comprises a sheet or curtain material.

8. The machine of claim 1 further comprising a heat producing device in at least one zone of the multiple zones.

9. The machine of claim 8 wherein the heat producing device is a foil heater.

10. The machine of claim 1 further comprising a thermostat.

11. The machine of claim 10 further comprising a controller to monitor the thermostat and operate the refrigeration unit and a fan in response to the thermostat.

12. The machine of claim 11 further comprising a heat producing device and wherein the controller monitors and operates the heat producing device.

13. The machine of claim 11 further comprising a second fan and wherein the controller operates the second fan.

14. The Machine of claim 1 wherein there are two temperature zones.

15. The machine of claim 14 wherein one temperature zone comprises sub-freezing temperatures.

16. The machine of claim 14 wherein one temperature zone comprises above freezing temperatures.

17. The machine of claim 14 wherein one temperature zone comprises sub-freezing temperatures and the other temperature zone comprises a temperature in the range of just above freezing to 42 degrees F.

18. The machine of claim 17 further comprising a third temperature zone.

19. The machine of claim 18 wherein the third zone comprises a temperature above 42 degrees F.

* * * * *